US007191474B2

(12) United States Patent
Matsunaga et al.

(10) Patent No.: US 7,191,474 B2
(45) Date of Patent: Mar. 20, 2007

(54) AUTOMATIC SHAMPOO MACHINE

(75) Inventors: Hideaki Matsunaga, Moriguchi (JP); Takenari Yuki, Moriguchi (JP); Tomo Nishimura, Moriguchi (JP); Masaru Noro, Moriguchi (JP); Tatsuhiko Yoshii, Moriguchi (JP); Masatsugu Ito, Osaka (JP)

(73) Assignees: Sanyo Electric Co., Ltd., Osaka (JP); Takara Belmont Corp., Osaka (JP); Sanyo Electric Techno Clean Co., Ltd., Osaka (JP)

( * ) Notice: Subject to any disclaimer, the term of this patent is extended or adjusted under 35 U.S.C. 154(b) by 116 days.

(21) Appl. No.: 10/490,360

(22) PCT Filed: Oct. 3, 2002

(86) PCT No.: PCT/JP02/10311

§ 371 (c)(1),
(2), (4) Date: Mar. 22, 2004

(87) PCT Pub. No.: WO03/030676

PCT Pub. Date: Apr. 17, 2003

(65) Prior Publication Data

US 2004/0261169 A1 Dec. 30, 2004

(30) Foreign Application Priority Data

Oct. 5, 2001 (JP) ..... 2001-310404
Mar. 22, 2002 (JP) ..... 2002-081804

(51) Int. Cl.
*A45D 19/00* (2006.01)

(52) U.S. Cl. ..... 4/515

(58) Field of Classification Search ..... 4/515–520
See application file for complete search history.

(56) References Cited

U.S. PATENT DOCUMENTS 1,309,694 A * 7/1919 Pritchard ..... 4/517

(Continued)

FOREIGN PATENT DOCUMENTS

JP 63-140244 9/1988

(Continued)

*Primary Examiner*—Charles E. Phillips
(74) *Attorney, Agent, or Firm*—Rabin & Berdo, PC

(57) ABSTRACT

There is a demand for an automatic shampoo machine used in beauty solons and the like which dispenses with an all-purpose chair to be prepared separately and has a better appearance and an improved feeling of use.

In an automatic shampoo machine 1, a seat 2 for seating a person to be shampooed thereon during shampooing and a basin 13 for receiving the person's head for the shampooing are supported by a common housing 3. The housing 3 accommodates and supports spout means 4 for spouting warm water automatically in the basin 13. Since the seat 2 is integrated in the automatic shampoo machine 1, the need for separately preparing a chair is obviated and the automatic shampoo machine 1 has an improved appearance. By using a space below the seat 2 effectively, functional components of the spout means 4 such as a warm water reservoir tank 45 are disposed in the space and the components can more flexibly be laid out. Aback-rest 8 of the seat 2 is arranged to incline so that the person's face is naturally oriented vertically upward, thereby alleviating a burden on the neck of the person. A seating portion 7 of the seat 2 is adjustable in height, thereby making it possible to properly position the person's neck in the basin 13, accommodating the variations in sitting height.

5 Claims, 17 Drawing Sheets

U.S. PATENT DOCUMENTS

| | | | | |
|---|---|---|---|---|
| 3,343,530 | A * | 9/1967 | Solos et al. | 601/159 |
| 4,918,767 | A * | 4/1990 | Benting | 4/517 |
| 6,615,418 | B2 * | 9/2003 | Minami | 4/515 |

FOREIGN PATENT DOCUMENTS

| | | |
|---|---|---|
| JP | 3-114405 | 5/1991 |
| JP | 11-187919 | 7/1999 |
| JP | 2001-211951 | 8/2001 |
| JP | 2001-231652 | 8/2001 |
| JP | U3081406 | 8/2001 |

* cited by examiner

AUTOMATIC SHAMPOO MACHINE

TECHNICAL FIELD

The present invention relates to an automatic shampoo machine for business use in barbershops, beauty salons and the like.

Prior Art

Automatic shampoo machines are known which are adapted to automatically perform a shampooing operation by spouting cleaning water (warm water, warm water mixed with a shampoo liquid and warm water mixed with a treatment liquid) over the head and hair of a person being shampooed. The automatic shampoo machines are used, for example, in beauty salons and the like, and acquire a reputation for excellent shampooing performance among customers.

The automatic shampoo machines include a basin provided in a housing for shampooing, the basin having an opening at its top for receiving the person's head. A chair for the person to be shampooed is disposed in front of the automatic shampoo machine. The person sits on the chair, and assumes a supine attitude on the back-rest of the chair reclined rearward. Thus, the person's head is inserted in the opening of the basin for the shampooing.

The chair to be used for the shampooing is an all-purpose reclinable chair which is prepared separately from the automatic shampoo machine.

Meanwhile, the beauty salons acknowledge the importance of the salons' atmospheres and, therefore, tend to employ an automatic shampoo machine of an uncommon design or of a design matched with the parlors' interiors. However, the all-purpose chair is not matched with the automatic shampoo machine of such a design.

Further, there are some cases where the all-purpose chair is not suitable for the automatic shampoo machine. Therefore, it is difficult to properly adjust the chair for the automatic shampoo machine, so that water leakage from the automatic shampoo machine is liable to occur during the shampooing operation. Hence, there is a demand for an automatic shampoo machine which dispenses with the all-purpose chair.

DISCLOSURE OF THE INVENTION

It is an object of the present invention to solve the aforesaid technical drawbacks to provide an automatic shampoo machine having a better appearance.

It is another object of the present invention to provide an automatic shampoo machine which ensures more comfortable use while preventing water leakage and the like.

According to an inventive aspect as set forth in claim 1, there is provided an automatic shampoo machine, which comprises: a basin having an open top for receiving a head of a person to be shampooed with a face of the person upward; spout means for spouting warm water for automatically shampooing the person's head received in the basin; a seat disposed in front of the basin for seating the person thereon for the shampooing; and a support member which supports the seat and the basin together.

According to this inventive aspect, the seat is integrated in the automatic shampoo machine, thereby obviating the need for separately preparing an all-purpose chair. The automatic shampoo machine has an improved appearance with a design of the basin and the seat integrated together.

According to an inventive aspect as set forth in claim 2, the automatic shampoo machine of claim 1 is characterized in that the seat has a seating portion and a back-rest, and the back-rest extends upward toward the basin from a front side to be inclined at an inclination angle, which is set so that the person's face is oriented generally vertically upward when the person reclines on the back-rest.

According to this inventive aspect, the head of the person sitting on the seat can properly be positioned in the basin. Therefore, it is possible to prevent occurrence of a gap between the periphery of the opening of the basin and the person's neck, thereby preventing water leakage from the gap during the shampooing. Further, a burden on the neck can be alleviated, because the inclination angle is set so that the person's face is oriented generally vertically upward.

According to an inventive aspect as set forth in claim 3, the automatic shampoo machine of claim 2 is characterized in that the seating portion of the seat is adjustable in height. According to this inventive aspect, it is possible to properly and assuredly position the person's neck on the basin, while accommodating variations in sitting height among persons to be shampooed. This is advantageous for the prevention of the water leakage.

According to an inventive aspect as set forth in claim 4, the automatic shampoo machine of claim 3 is characterized in that the seating portion of the seat is movable along the inclination of the back-rest for the adjustment of the height. According to this inventive aspect, the seating comfort on the seat can properly be maintained irrespective of the height of the seating portion.

According to an inventive aspect as set forth in claim 5, the automatic shampoo machine of claim 2 is characterized in that the position of the seating portion of the seat is anteroposteriorly adjustable. According to this inventive aspect, it is possible to properly and assuredly position the person's neck on the basin, while accommodating the variations in seating height among persons to be shampooed. This is advantageous for the prevention of the water leakage.

According to an inventive aspect as set forth in claim 6, the automatic shampoo machine of any of claims 2 to 5 is characterized in that the inclination angle of the back-rest is adjustable in accordance with the positional adjustment of the seating portion. Where the position of the seating portion is adjusted with the position of the back-rest being fixed, for example, a step is formed between the seating portion and the back-rest thereby to deteriorate the seating comfort on the seat. With the arrangement according to this claim, however, the step can be suppressed, so that the seating comfort on the seat can properly be maintained irrespective of the position of the seating portion.

According to an inventive aspect as set forth in claim 7, the automatic shampoo machine of claim 2 is characterized in that the basin is adjustable in position. According to this inventive aspect, it is possible to properly and assuredly position the person's neck on the basin, while accommodating the variations in seating height among persons to be shampooed. This is advantageous for the prevention of the water leakage.

According to an inventive aspect as set forth in claim 8, the automatic shampoo machine of any of claims 1 to 7 is characterized in that the seat has a seating portion and a back-rest, and the back-rest is reclinable. By reclining the back-rest, the person to be shampooed is smoothly brought into a supine attitude for the shampooing.

According to an inventive aspect as set forth in claim 9, the automatic shampoo machine of any of claims 1 to 8 is characterized in that the support member supports a functional component of the spout means below the seat.

According to this inventive aspect, the functional component can more flexibly be laid out through the effective use of a free space below the seat.

According to an inventive aspect as set forth in claim 10, the automatic shampoo machine of claim 9 is characterized in that the functional component supported below the seat includes a tank which is capable of storing water.

According to this inventive aspect, without the provision of a generally large tank in a narrow space below the basin, components such as pipes and valves can more flexibly be laid out in the space below the basin for facilitating the maintenance of these components.

According to an inventive aspect as set forth in claim 11, the automatic shampoo machine of any of claims 1 to 10 further comprises an operation panel for the spout means, wherein the operation panel is at least partly located forwardly of a rear edge of the seat.

According to this inventive aspect, a space for the layout of the operation panel around the opening of the basin can be reduced or eliminated, so that the peripheral size of the opening of the basin can be reduced. As a result, an operator can easily access the head of the person received in the basin and, hence, easily perform a manual shampooing operation and the like.

According to an inventive aspect as set forth in claim 12, the automatic shampoo machine of any of claims 1 to 11 is characterized in that the support member is provided with transport means for transport of the machine. According to this inventive aspect, the automatic shampoo machine can easily be transported. In addition, it is not necessary to prepare a shampoo chair for the shampooing operation to be performed at a site to which the automatic shampoo machine is transported. An example of the transport means is wheels.

According to an inventive aspect as set forth in claim 13, the automatic shampoo machine of any of claims 1 to 12 is characterized in that the seat is provided with means for massaging the person. According to this inventive aspect, it is possible to realize comfortable shampooing together with a head massaging effect provided by the warm water spouted in the basin.

According to an inventive aspect as set forth in claim 14, there is provided an automatic shampoo machine, which comprises: a shampooing section for receiving a head of a person to be shampooed and performing a shampooing operation by spouting cleaning water toward the head; a seating section for receiving a body of the person during the shampooing operation; and connection means which connects the shampooing section with the seating section, wherein the shampooing section and the seating section are separable from each other by the connection means.

According to an inventive aspect as set forth in claim 15, the shampooing section may comprise a basin for receiving the person's head to be inserted therein and a basin retaining part which retains the basin, and the seating section may comprise a seat for seating the person thereon and a seat retaining part which retains the seat.

The seat for seating the person thereon is positioned with its back-rest located adjacent the basin. When the shampooing operation is to be performed, the person sits on the seat with his back to the basin, and the back-rest of the seat is reclined, whereby the person assumes a supine attitude with the person's head inserted in the basin.

According to the inventive arrangement, the shampooing section is separable from the seating section. With the shampooing section connected with the seating section, unitization with the seat is improved as compared with a case where the all-purpose chair is separately provided.

The connection between the shampooing section and the seating section may be achieved by connecting the basin retaining part with the seat retaining part, by connecting the basin retaining part with the seat, or by connecting the basin with the seat retaining part. Alternatively, the connection between the shampooing section and the seating section may be achieved by connecting the basin with the seat.

According to an inventive aspect as set forth in claim 16, the automatic shampoo machine of claim 14 or 15 is characterized in that the basin retaining part and the seat retaining part are slidable with respect to each other so as to be brought into engagement with each other.

With this arrangement, the unitization of the basin retaining part and the seat retaining part can be improved by engaging the seat retaining part and the basin retaining part with each other.

In this case, a separate member (exterior panel) may be provided for hiding a gap (engagement gap) defined between the basin retaining part and the seat retaining part. Thus, the gap can be hidden, whereby the appearance of the machine and the unitization of the basin retaining part and the seat retaining part can be improved.

According to an inventive aspect as set forth in claim 17, the automatic shampoo machine of any of claims 14 to 16 further comprises an electrical component for controlling an operation of the automatic shampoo machine (an electrical component box, e.g., a control board for controlling the automatic shampoo machine), wherein the electrical component is positioned below the seat.

With this arrangement, the electrical component can be disposed apart from the basin, so that the electric leakage and the malfunction of the electrical component can be prevented which may otherwise occur due to splash of water.

According to an inventive aspect as set forth in claim 18, the automatic shampoo machine of any of claims 14 to 17 further comprises an operation panel for operating the automatic shampoo machine, and an arm-rest provided on a lateral side of the seat for receiving an arm of the person sitting on the seat, wherein the operation panel is located on the arm-rest at a position closer to the basin than a portion of the arm-rest on which the person's arm is rested and inclined at a predetermined angle with respect to a vertical axis.

With this arrangement, the operator (a staff member of a beauty salon) who stands behind the automatic shampoo machine for operation can easily operate the operation panel, because the operation panel is located on the arm-rest at the position closer to the basin than the portion of the arm-rest on which the person's arm is rested and inclined at the predetermined angle with respect to the vertical axis.

According to an inventive aspect as set forth in claim 19, the automatic shampoo machine of any of claims 14 to 18 further comprises a housing rear face defining a lower rear portion of the basin, wherein the rear face has an oblique surface inclined forwardly downward to provide a free space on a lower rear side of the basin.

With this arrangement, where the operator manually shampoos the person behind the automatic shampoo machine, the operator can more easily access the person with the operator's feet inserted in the free space. Thus, the shampooing operation is facilitated.

According to an inventive aspect as set forth in claim 20, the automatic shampoo machine of any of claims 14 to 19 further comprises a warm water reservoir tank for storing warm water for use as the cleaning water, wherein the warm water reservoir tank is positioned between the basin and the seat.

In general, where the back-rest of the seat is reclined for the shampooing, the back-rest is adapted to be inclined in an angular range of not greater than a predetermined angle (e.g., 35 degrees) with respect to a horizontal axis. Therefore, a free space defined between the basin and the seat extends to a relatively high level.

With the inventive arrangement, this free space is advantageously utilized for the provision of the warm water reservoir tank.

EMBODIMENTS OF THE INVENTION

Figure 1:
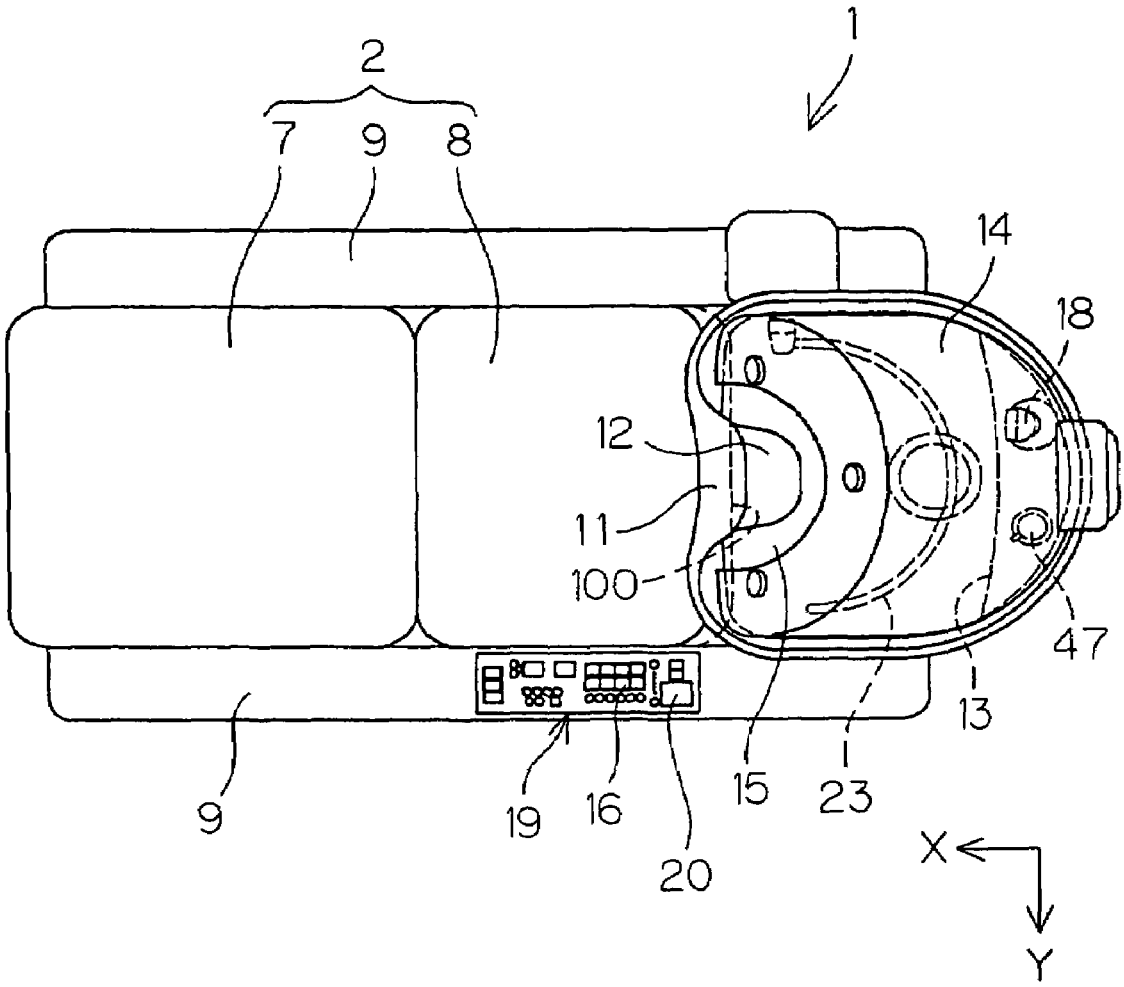
FIG. 1 is a plan view illustrating the exterior of an automatic shampoo machine according to one embodiment of the present invention.
Figure 2:
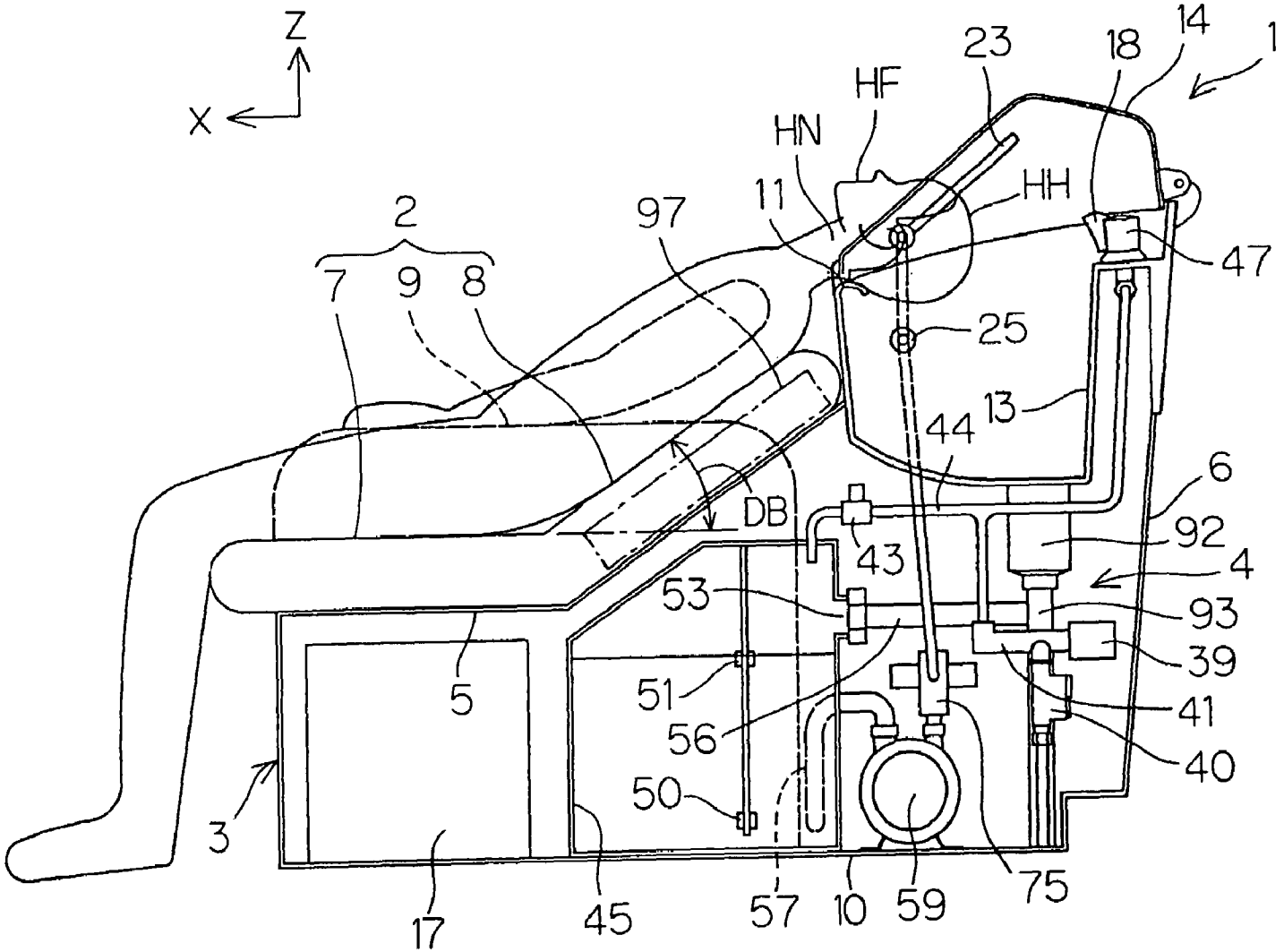
FIG. 2 is a side view schematically illustrating partially in section the construction of the automatic shampoo machine shown in FIG. 1 together with a person being shampooed.

An automatic shampoo machine according to one embodiment of the present invention will hereinafter be described with reference to the drawings. FIG. 1 is a plan view illustrating the exterior of the automatic shampoo machine according to the one embodiment of the present invention, and FIG. 2 is a side view schematically illustrating the construction of the automatic shampoo machine partially in section. In the drawings, an arrow X indicating an anteroposterior axis, an arrow Y indicating a lateral axis and an arrow Z indicating a vertical axis are shown as required.

The automatic shampoo machine 1 includes a seat 2 on which a person to be shampooed is seated for shampooing, a basin 13 disposed rearwardly of the seat 2, and a housing 3 as a support member for supporting the basin 13 and the seat 2 together. Spout means 4 for spouting warm water toward the head of the person in the basin 13 for an automatic shampooing operation is disposed in the housing 3. The spout means 4 includes pumps, water channels, a control section and the like to be described later.

The housing 3 includes a front portion 5 located below the seat 2, and a rear portion 6 located rearwardly of the front portion as projecting upward and accommodating the basin 13. The rear portion 6 of the housing 3 has an opening 12 provided in a center portion of a top face thereof to permit the person's head to be inserted into the basin 13. The opening 12 is located above the basin 13 so that the person's head and hair can be received in the basin 13.

A hood 14 for covering the periphery of the face of the person is openably provided on the opening 12. With the hood 14 being open, the person's head is received in the basin 13 for the shampooing. In the shampooing operation, the hood 14 is closed. The person is shampooed, while being seated on the seat 2 in a supine attitude with the person's head inserted in the opening 12 and with the person's face exposed from the hood 14.

The hood 14 openably covers an upper portion of the basin 13 with the person's face being exposed. Therefore, the hood 14 has a cut-away portion which is located on the front side thereof when the hood 14 is closed. A generally U-shaped face seal 15 of a flexible sealing material is provided along a peripheral edge of the cut-away portion. The face seal 15 fits on the person's face to seal the periphery of the face.

An electrical component 17 is provided below a seating portion 7 of the seat 2 in the housing 3. A warm water reservoir tank 45 for storing warm water for the shampooing is provided below a back-rest 8 of the seat 2. A drain channel including a pipe 93 and the like for draining water from the basin 13, a water supply channel including a pipe 44 and the like for supplying warm water into the warm water reservoir tank 45, and a spout channel including pipes 57, 75 and the like for feeding warm water out of the warm water reservoir tank 45 and spouting the warm water from nozzles in the basin 13 by a pump 59 are disposed below the basin 13, and piping components such as pipes and valves for these channels are housed below the basin 13.

An operation panel 19 is provided on an upper face portion of the housing 3, for example, rearward of a portion of the housing which serves as an arm-rest 9 of the seat 2. Various key switches 16 for inputting operation signals to a control section (not shown) including a microprocessor and the like are arranged on the operation panel. By operating the key switches 16, the warm water is spouted in the basin 13 for the shampooing operation.

Figure 3:
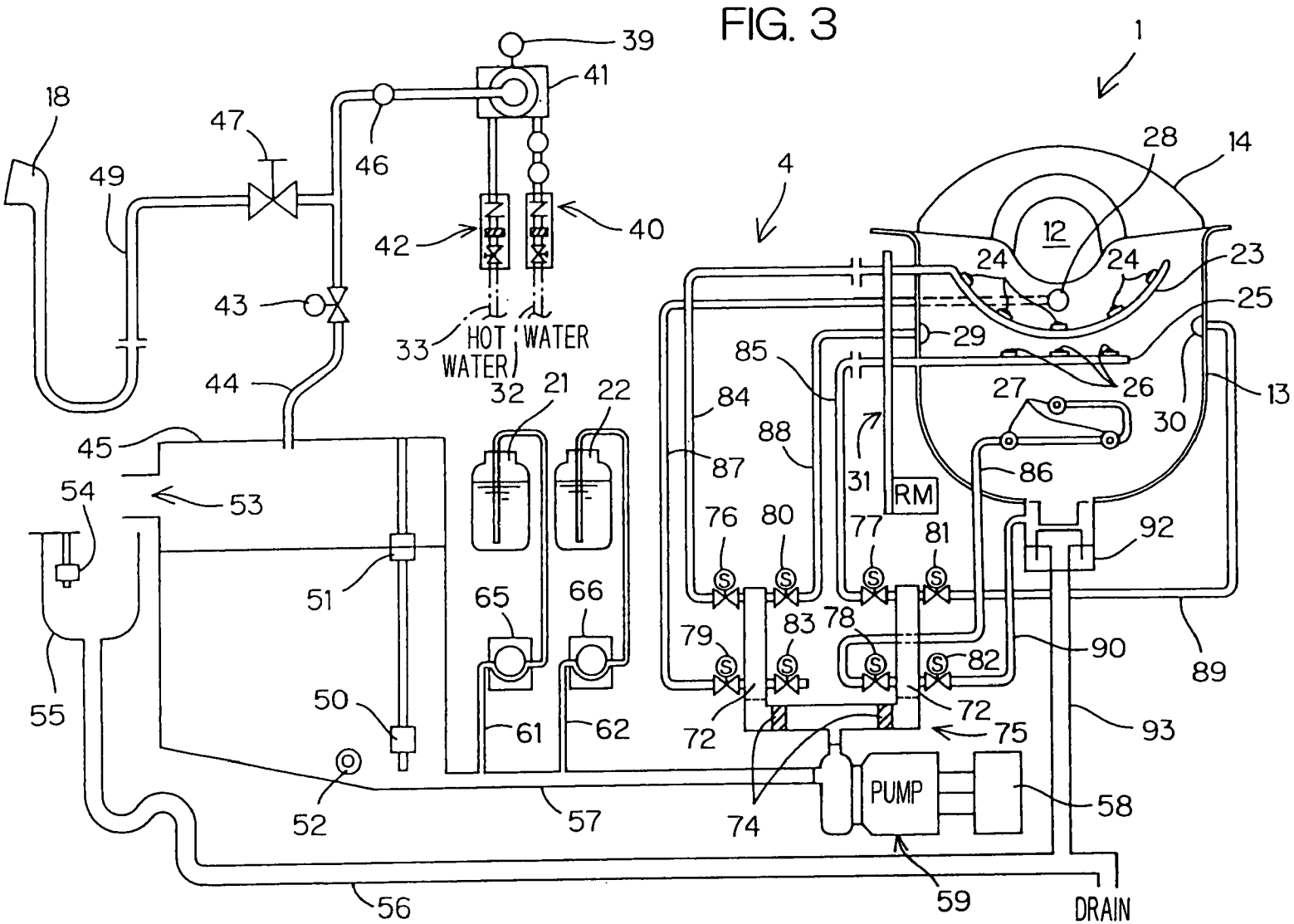
FIG. 3 is a water channel diagram for the automatic shampoo machine shown in FIG. 1.

A plurality of nozzles 24, 26, 27 to 30 for spouting warm water are provided in the basin 13 as shown in water channel diagrams of FIGS. 2 and 3. These nozzles include upper nozzles 24 and lower nozzles 26 provided on a head nozzle link (hereinafter referred to as "upper nozzle link") 23 and a nape nozzle link (hereinafter referred to as "lower nozzle link") 25, respectively, for spouting warm water in variable spouting directions, and a plurality of fixed nozzles 27 to 30 fixed to a peripheral wall of the basin 13. These fixed nozzles 27 to 30 are located at fixed positions in the basin 13, but their warm water spouting directions are adjustable.

The upper nozzle link 23 is located in an upper portion of the basin 13, and has a generally semicircular shape so as to surround the person's head inserted in the basin. The upper nozzle link 23 is pivotally attached at its end to the peripheral wall of the basin 13 so as to be swung between a position diagonally above the person's head and a position diagonally below the person's head. The plural upper nozzles 24 are arranged along the upper nozzle link 23 and oriented toward the head. The head and the proximal portions of hair can be washed by warm water spouted from the upper nozzles 24, and the head skin can be massaged by the spouted warm water.

The lower nozzle link 25 is located below the person's head in the basin 13, and has a rod shape. The lower nozzle link 25 is supported at its end on the peripheral wall of the basin 13 pivotally about it's rod axis. The plural lower nozzles 26 are arranged on the circumference of the lower nozzle link 25 and oriented toward the head. The proximal portions of the hair and the nape can be washed by warm water spouted from the lower nozzles 26.

The plural fixed nozzles 27 to 30 are fixed on the peripheral wall of the basin 13. A plurality of fixed nozzles 27, e.g., three fixed nozzles, are relatively provided on lower front and rear portions of the interior wall of the basin 13 mainly for washing the distal portions of the hair when the hair is long. These fixed nozzles 27 are connected to a single pipe 86 and adapted to spout warm water supplied from the pipe 86. The fixed nozzles 28, 29, 30 are respectively provided on an upper rear portion and right and left side portions of the interior wall of the basin 13 mainly for massaging the head skin by the spouted warm water. The fixed nozzles 28, 29 and 30 are respectively connected to pipes 87, 88 and 89.

Next, an explanation will be given to water channels for supplying warm water to the respective nozzles.

Warm water for the shampooing is supplied into the automatic shampoo machine 1 from an external tap water supply and a boiler. Water supplied from a water supply pipe 32 connected to the tap water supply is applied to a mixing valve 41 via a water supply portion 40. The water supply portion 40 is a unit including a manually operable valve, a filter, a check valve, an accumulator, a safety valve and the like. Hot water supplied through a hot water supply pipe 33 from the boiler is applied to the mixing valve 41 via a hot water supply portion 42. The hot water supply portion 42 is a unit including a manually operable valve, a filter, a check valve and the like. In the mixing valve 41, the applied water and hot water are mixed together to prepare warm water having a proper temperature. The mixing valve 41 is driven by a motor 39. The temperature of the warm water prepared by the mixing valve 41 is adjustable by operating the operation panel 19 by the operator.

The warm water prepared by the mixing valve 41 is introduced into a hand shower 18 via a supply hose 49 when a shower valve 47 is opened. As a result, the warm water can be spouted from the hand shower 18.

The warm water prepared by the mixing valve 41 is also supplied to the warm water reservoir tank 45 via the supply pipe 44 when a warm water supply valve 43 is opened. The supply pipe 44 is provided with a thermistor 46 for detecting the temperature of the warm water supplied from the mixing valve 41.

A lower water amount sensor 50 and an upper water amount sensor 51 for detecting the amount of warm water stored in the warm water reservoir tank 45 is provided in the warm water reservoir tank 45. Outputs of the lower water amount sensor 50 and the upper water amount sensor 51 are utilized for the open/close control of the warm water supply valve 43 by the microprocessor. Thus, the warm water reservoir tank 45 is constantly filled with a proper amount of warm water.

A thermistor 52 for detecting the temperature of the warm water stored in the warm water reservoir tank 45 is provided at a lower position in the warm water reservoir tank 45.

An overflow port 53 for causing excess warm water to overflow out of the warm water reservoir tank 45 when the warm water is stored in an amount greater than the detection limit of the upper water amount sensor 51 is provided at an upper position of the warm water reservoir tank 45. A drain pan 55 is provided below the overflow port 53. The warm water overflowing from the overflow port 53 is received in the drain pan 55, and drained out of the machine through a drain pipe 56 extending from the drain pan 55 to the outside of the machine.

A water level sensor 54 is provided in the drain pan 55. The water level sensor is adapted to detect abnormal fill-up of the drain pan 55 which may occur when warm water once drained through the drain pipe 56 flows back into the drain pan.

The outlet pipe 57 is connected to a lower portion of the warm water reservoir tank 45. The other end of the outlet pipe 57 is connected to a suction port of a pump 59. The pump 59 is driven by application of an AC current from an inverter 58. When the pump 59 is driven, the warm water stored in the warm water reservoir tank 45 is sucked into the pump 59 through the outlet pipe 57.

A shampoo liquid supply pipe 61 and a treatment liquid supply pipe 62 are joined to the midst of the outlet pipe 57. The shampoo liquid supply pipe 61 connects a shampoo liquid container 21 to the outlet pipe 57 via a shampoo liquid pump 65. The treatment liquid supply pipe 62 connects a treatment liquid container 22 to the outlet pipe 57 via a treatment liquid pump 66. A shampoo liquid is stored in the shampoo liquid container 21, and a treatment liquid is stored in the treatment liquid container 22. These containers 21, 22 are removably disposed in the housing 3. These containers 21, 22 may be mounted as being exposed to the top face of the housing 3.

The shampoo liquid pump 65 and the treatment liquid pump 66 are respectively adapted to pump up the shampoo liquid and the treatment liquid stored in the shampoo liquid container 21 and the treatment liquid container 22 by squeezing the pipes 61 and 62 to feed out the shampoo liquid and the treatment liquid via the pipes 61 and 62.

With this arrangement, the shampoo liquid is supplied into the outlet pipe 57 stored in the shampoo liquid container 21 via the shampoo liquid supply pipe 61 by driving the shampoo liquid pump 65 when the pump 59 is driven by the inverter 58. As a result, the shampoo liquid is mixed with the warm water for preparation of warm shampoo water.

Similarly, the treatment liquid stored in the treatment liquid container 22 is supplied into the outlet pipe 57 via the treatment liquid supply pipe 62 by driving the treatment liquid pump 66 when the pump 59 is driven. As a result, the treatment liquid is mixed with the warm water for preparation of warm treatment water.

The warm water, the warm shampoo water or the warm treatment water sucked into the pump 59 is discharged from an outlet of the pump 59. The outlet of the pump 59 is connected to a branch pipe 75 which is branched into a plurality of branches, e.g., eight branches.

The branch pipe 75 is provided with filters 74. Eight valves, i.e., an upper nozzle valve 76, a lower nozzle valve 77, fixed nozzle valves 78 to 81, a drain valve 82 and a spare valve 83 are connected to the respective ends of the branches disposed downstream of the filters. The spare valve 83 may be dispensed with. Pipes 84 to 90 are respectively connected through the valves except the spare valve 83.

A distal end of the pipe 84 is connected to the upper nozzle link 23. A distal end of the pipe 85 is connected to the lower nozzle link 25. A distal portion of the pipe 86 is disposed outwardly of the peripheral wall of the basin 13, and the aforesaid plural fixed nozzles 27 are arranged at predetermined intervals along the distal portion of the pipe 86. Distal ends of the pipes 87 to 89 are respectively connected to the fixed nozzles 28 to 30 provided on the peripheral wall of the basin 13. A distal end of the pipe 90 is connected to the drain pipe 56 via a drain trap 92 and a drain pipe 93 connected to a bottom lower portion of the basin 13.

With this arrangement, the warm water, the warm shampoo water or the warm treatment water is spouted from desired ones of the nozzles in the basin 13 by driving the pump 59 by the inverter 58 and selectively opening the valves 76 to 81 as required for automatically shampooing the person's hair.

The upper nozzle link 23 is swung and the lower nozzle link 25 is pivoted by a driving mechanism 31 during the shampooing operation. As a result, the spouting directions of the warm water spouted from the upper nozzles 24 and the lower nozzles 26 are varied, whereby the person's hair can uniformly and properly be shampooed.

In the shampooing operation, the person being shampooed assumes a supine attitude with the person's neck rested on a neck-rest 11 defined as an indentation on the periphery of the opening 12 of the basin 13.

In the present invention, the seat 2 on which the person is seated in the aforesaid attitude in the shampooing operation is provided integrally in the automatic shampoo machine 1. Therefore, the seat 2 is located in front of the basin 13, and the aforesaid housing 3 supports the seat 2 and the basin 13 together.

Since the automatic shampoo machine 1 includes the integrally provided seat 2, there is no need to separately prepare an all-purpose chair. Further, the automatic shampoo machine has an improved appearance with a design of the basin 13 and the seat 2 integrated together.

The housing 3 is constituted by a plurality of components of a hard material such as a metal or a synthetic resin. Alternatively, the housing 3 may be constituted by a single component.

The seat 2 and the basin 13 are positioned with respect to each other and connected with each other by the housing 3 so as to be integrally handled. The housing 3 supports the seat 2 and the basin 13 in a predetermined positional relationship. Thus, the positions of the seat 2 and the basin 13 are restricted vertically, anteroposteriorly and laterally.

The housing 3 functions as a cover which surrounds the seat 2 and the basin 13 to entirely cover the periphery of the seat and the basin from the front, rear, right and left sides. Thus, the housing defines the exterior of the machine so that the seat 2 and the basin 13 look integral. The housing 3 provided as the cover surrounding the seat 2 and the basin 13 so that the seat and the basin look integral is advantageous for improving the exterior appearance. At least one of the seat 2 and the basin 13 may be provided with a cover which covers lateral sides of the other.

The housing 3 includes a front portion 5 as a first portion which supports the seat 2, a rear portion 6 as a second portion which supports the basin 13, and an intermediate portion 10 as a connection portion which connects the first portion with the second portion, and functions as an inventive support member which supports the basin 13 and the seat 2 together.

The inventive support member is merely required to be capable of supporting the basin 13 and the seat 2 together and include the first and second portions and the connection portion described above. These portions may be integrally formed or separately provided. These portions may be provided integrally with at least one of the basin 13 and the seat 2. The connection portion may connect the first and second portions directly or indirectly via a separate member such as the basin 13 or the seat 2. For example, one end of the connection portion may be fixed to the first portion, and the other end of the connection portion may be fixed to the second portion. Alternatively, the connection portion may connect the first portion and the second portion via the seat 2 and the basin 13 with one end thereof being fixed to the seat 2 and with the other end thereof being fixed to the basin 13. The connection portion may function as a hand rail or as a cover which defines the exterior of the automatic shampoo machine 1 to cover the lateral sides of the seat 2 and the basin 13.

The seat 2 integrally provided in the automatic shampoo machine 1 may be solely optimized for the shampooing. For example, the height of the seating portion 7, the inclination angle of the back-rest 8 and the position of the neck-rest 11 on the periphery of the opening of the basin 13 may properly be set in the following manner to ensure that the person's head can easily and properly be positioned in the opening 12 of the basin 13 simply by seating the person on the seat 2.

The seat 2 includes the seating portion 7 having a generally horizontal seating surface at a top thereof, the back-rest 8 provided behind the seating portion 7 as being inclined obliquely with respect to the seating portion 7, and the arm-rests 9 provided on right and left sides of the seating portion 7. As will be described later, the back-rest 8 may be inclined at different angles. An explanation will be given mainly to a state of the back-rest in the shampooing operation, and given to the other states of the back-rest on a case-by-case basis.

The back-rest 8 of the seat 2 is inclined obliquely upward from a rear edge of the seating portion 7 provided forwardly thereof toward the neck-rest 11 on the periphery of the opening 12 of the basin 13. With the seat 2 thus positionally restricted, the head of the person sitting on the seat 2 can properly and assuredly be positioned on the neck-rest 11 on the periphery of the opening of the basin 13. This makes it possible to prevent occurrence of a gap between the neck-rest 11 on the periphery of the opening of the basin 13 and the person's neck, thereby preventing water leakage from the gap during the shampooing operation.

Though not shown, the components 7, 8, 9 of the seat 2 each include a support member defining a basic configuration for supporting the seated person, a cushioning member intervening between the support member and the person for ensuring a seating comfort, and a covering member which covers the cushioning member. Examples of the cushioning member include resilient members such as springs, and cushions. Examples of the covering member include sheet materials such as fabrics and leathers. At least one of the seating portion 7, the back-rest 8 and the arm-rests 9 may be without the cushioning member and the covering member described above, and the support member thereof may be provided integrally with the housing 3. What is important is that the seat 2 is constructed so that the person can assume a supine attitude on the seat 2 during the shampooing operation.

The inclination angle (indicated by a reference character DB in FIG. 2) of the back-rest 8 is set at a predetermined angle for the shampooing. This inclination angle is predetermined so that the person's face is oriented generally vertically upward when the person naturally sits on the seat 2 with the person's neck relaxed and with the person's back leaned on the back-rest 8 of the seat 2.

The inclination angle for orienting the face generally vertically upward may be defined within an angular range between an inclination angle for keeping the face horizontal and an inclination angle for orienting the face slightly forward. The inclination angle for keeping the face horizontal is such that a line extending from the neck to the parietal portion of the person forms an angle of 0 degree with respect to a horizontal plane. More specifically, the inclination angle of the back-rest 8 is in an angular range of 30 degrees to 35 degrees, for example, 32 degrees. The inclination angle for orienting the face slightly forward is such that the line extending from the neck to the parietal portion forms an angle of 15 degrees with respect to the horizontal plane. More specifically, the inclination angle of the back-rest 8 is 50 degrees.

The inclination angle is thus set within an angular range of not smaller than 30 degrees and not greater than 50 degrees for orienting the face generally vertically upward, whereby the neck can naturally be kept at an angle suitable for the shampooing. That is, the line extending from the neck to the parietal portion is inclined upward toward the parietal portion with respect to the generally horizontal plane, so that a burden on the neck can be alleviated as compared with a case where this line is inclined downward toward the parietal portion. In addition, it is possible to ensure that the operator can properly perform the manual shampooing operation, while properly maintaining the sealing between the face seal 15 and the forehead of the person being shampooed.

As the inclination angle becomes closer to 30 degrees within the aforesaid angular range (as the inclination of the neck becomes closer to the horizontal plane), the inclination of the forehead is minimized with the face oriented vertically upward. Therefore, water droplets adhering on the forehead during the shampooing are less liable to move toward the face seal 15 on the forehead, so that the sealing between the face seal 15 and the forehead can assuredly be maintained. Further, when the hood 14 is opened after the shampooing, the water droplets adhering on the forehead and the head are less liable to drip down on the face. This prevents the person from being discomforted.

As the inclination angle becomes closer to 50 degrees within the afore-said angular range (with the face being oriented slightly forward), the operator can more easily perform the manual shampooing operation.

If the inclination angle is greater than 50 degrees, the neck is excessively raised. Therefore, the water droplets are more liable to drip on the nape, and the sealing between the person's forehead and the face seal 15 is deteriorated. If the inclination angle is smaller than 30 degrees, the parietal portion is lowered. This increases the burden on the neck, and makes the manual shampooing operation difficult.

The inclination angle of the back-rest 8 is defined as an angle DB formed between the extension axis of the back-rest 8 and the horizontal line as seen in section taken laterally. The inclination angle within the aforesaid angular range is preferred for the manual shampooing operation. Where importance is placed on the sealing between the forehead and the face seal 15, however, the inclination angle of the back-rest 8 may be set within an angular range of 0 degree to 30 degrees.

The inclination angle of the back-rest 8 may be adjustable but, in this embodiment, is fixed at the predetermined angle for the shampooing. By fixing the back-rest 8, an attitude optimal for the shampooing can assuredly be realized with a simple construction.

Figure 4:
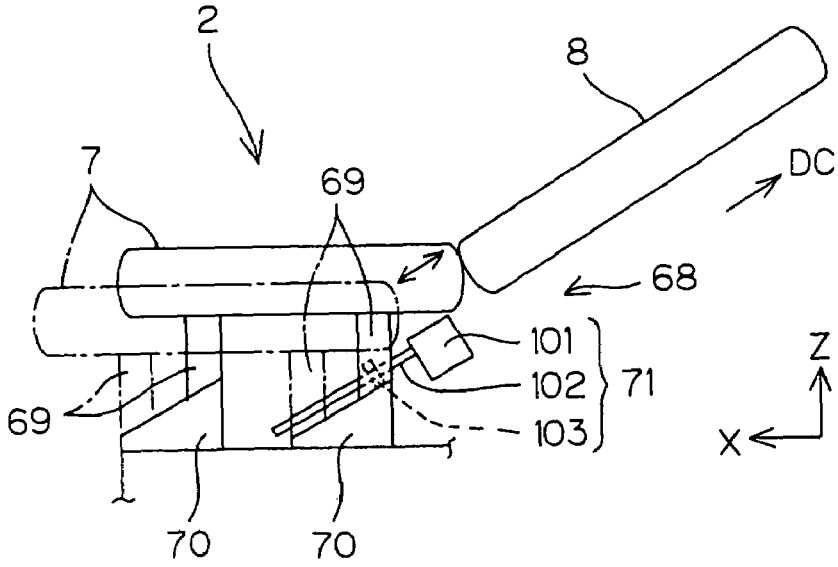
FIG. 4 is a schematic diagram illustrating the construction of a position adjusting mechanism for a seat shown in FIG. 2.

In this embodiment, the height of the seating portion 7 of the seat 2 is adjustable as shown in FIG. 4. Thus, variations in sitting height among persons to be shampooed can be accommodated. Therefore, the person's neck can assuredly be positioned on the neck-rest 11 on the periphery of the top opening of the basin 13, whereby the water leakage is advantageously prevented.

The seat 2 is provided with a position adjusting mechanism 68 for adjusting the height of the seating portion 7. The position adjusting mechanism 68 is adapted to move the seating portion 7 of the seat 2 along the inclination of the back-rest 8 (in an arrow direction DC). Thus, the seating comfort on the seat 2 can properly be maintained irrespective of the height of the seating portion 7, as compared with a case where the seating portion 7 is moved vertically. In addition, the back-rest 8 can be fixed.

As shown in FIG. 4, the position adjusting mechanism 68 includes a base 69 supporting the seating portion 7, a guide member 70 for guiding the base 69 along the inclination of the back-rest 8 in a relatively movable manner, and a movement mechanism 71 for moving the base 69 along the guide member 70. The movement mechanism 71 includes a motor 101 supported by the housing 3, a thread shaft 102 co-rotatable with a rotation shaft of the motor 101, and a nut 103 fixed to the base 69 in threading engagement with the thread shaft 102. The base 69 and the guide member 70 respectively have oblique surfaces, which are inclined along the inclination of the back-rest 8. The guide member 70 is fixed to the housing 3, and serves as a direct-acting guide mechanism for moving the base 69 obliquely. When the motor 101 of the movement mechanism 71 is driven, the thread shaft 102 is rotated, whereby the base 69 and the seating portion 7 are moved obliquely together with the nut 103 for the adjustment of the height of the seating portion 7. The position adjusting mechanism 68 may have a known construction, for example, in which the movement mechanism 71 is adapted to move the base 69 through a manual operation.

In this embodiment, the housing 3 supports the functional components of the spout means 4 below the seat 2 as described above. Thus, the free space below the seat 2 can effectively be utilized, so that the functional components can more flexibly be laid out.

The functional components supported below the seat 2 include, for example, the electrical component 17 and the warm water reservoir tank 45. The electrical component 17 can be located below the seating portion 7 apart from the basin 13. Therefore, even if the water leakage occurs, the electrical component 17 is prevented from being wet with water.

Further, the warm water reservoir tank 45 is located below the back-rest 8. Without the provision of a generally large tank in a narrow space below the basin 13, the components such as the pipes and the valves can more flexibly be laid out in the space below the basin 13 for facilitating the maintenance of the devices and the components disposed in the space below the basin. Besides the warm water reservoir tank 45 for storing warm water to be used for the shampooing, an example of such a tank is a used water storage tank.

Since the generally large warm water reservoir tank 45 is located away from the narrow space below the basin 13, the exterior size of the basin 13 can be reduced. As a result, the operator, e.g., a beautician, can more easily access the basin 13 and, hence, the person's head received in the basin, so that a final manual rinsing operation and the like is facilitated.

In this embodiment, the provision of the seat 2 increases the overall exterior size of the automatic shampoo machine 1, so that the flexibility of the layout of the functional components within the automatic shampoo machine 1 as well as the flexibility of the layout of the functional components on the exterior of the automatic shampoo machine 1 can be increased. For example, a component exposed to the outside in the case of the conventional automatic shampoo machine, e.g., the shampoo liquid container, can be accommodated within the automatic shampoo machine 1. Although the operation panel is located on the top face just beside the basin in the case of the conventional automatic shampoo machine, the operation panel 19 is located apart from the basin 13 in accordance with the embodiment of the invention.

The operation panel 19 is located on a lateral side of the seating portion 7 and the back-rest 8 of the seat 2 forwardly of a rear edge 100 of the back-rest 8 of the seat 2. Thus, it is not necessary to reserve a space for the operation panel 19 on the peripheral portion of the opening 12 of the basin 13, so that the width of the peripheral portion of the opening 12 of the basin 13 and, hence, the peripheral exterior size of the basin 13. (as seen in plan) can be reduced. As a result, the operator can get closer to the person's head received in the basin 13, so that the manual shampooing operation is facilitated. Since the peripheral exterior size of the basin 13 is reduced, the operator can stand behind the basin to perform the manual shampooing operation.

The operation panel 19 provided beside the seat 2 does not cause any inconvenience to the operator standing behind the basin. Therefore, the operator can concentrate on the operation without paying attention not to touch the operation panel 19 and, hence, easily perform the operation. In addition, the operator can operate the operation panel from the front side during the automatic shampooing operation. This arrangement generally presents no problem during the manual shampooing operation without the need for operating the operation panel 19.

Since the operation panel 19 is located apart from the opening 12 of the basin 13, water droplets from the basin 13 are less liable to adhere on the operation panel 19 as compared with the conventional case where the operation panel is located just beside the basin.

The operation panel 19 includes, as an operation member for the spout means 4, a plurality of key switches 16 for actuation and deactuation of the spout means 4, and a plurality of indicator members 20 such as lamps and a display device for indicating the operation state of the spout means 4. The operation panel 19 has an anteroposteriorly elongated shape, e.g., a rectangular shape, and is disposed on the lateral side of the back-rest 8 of the seat 2 just beside the back-rest.

Particularly, the entire operation panel 19 may be located forwardly of an inner front edge of the basin 13 and forwardly of the rear edge 100 of the back-rest 8 of the seat 2. Thus, the peripheral exterior size of the basin 13 can further be reduced.

Even if a portion of the operation panel 19 is located rearwardly of the rear edge 100 of the seat 2, the rest of the operation panel 19 can be located beside the seat 2. Therefore, a space required for locating the operation panel 19 on the periphery of the opening 12 of the basin 13 is reduced, so that the peripheral exterior size of the basin 13 can be reduced as described above. What is important is to locate at least part of the operation panel 19 on the lateral side of the seat 2 forwardly of the rear edge 100 of the seat 2.

The operation panel 19 further includes, as an operation member for the seat 2, a plurality of key switches 16 for operating the position adjusting mechanism 68 for the seat 2, and an indicator member 20 for indicating the state of the seat 2. Since the operation member for the adjustment of the seat 2 is located in the vicinity of the seat 2, more convenient use is ensured.

Figure 5:
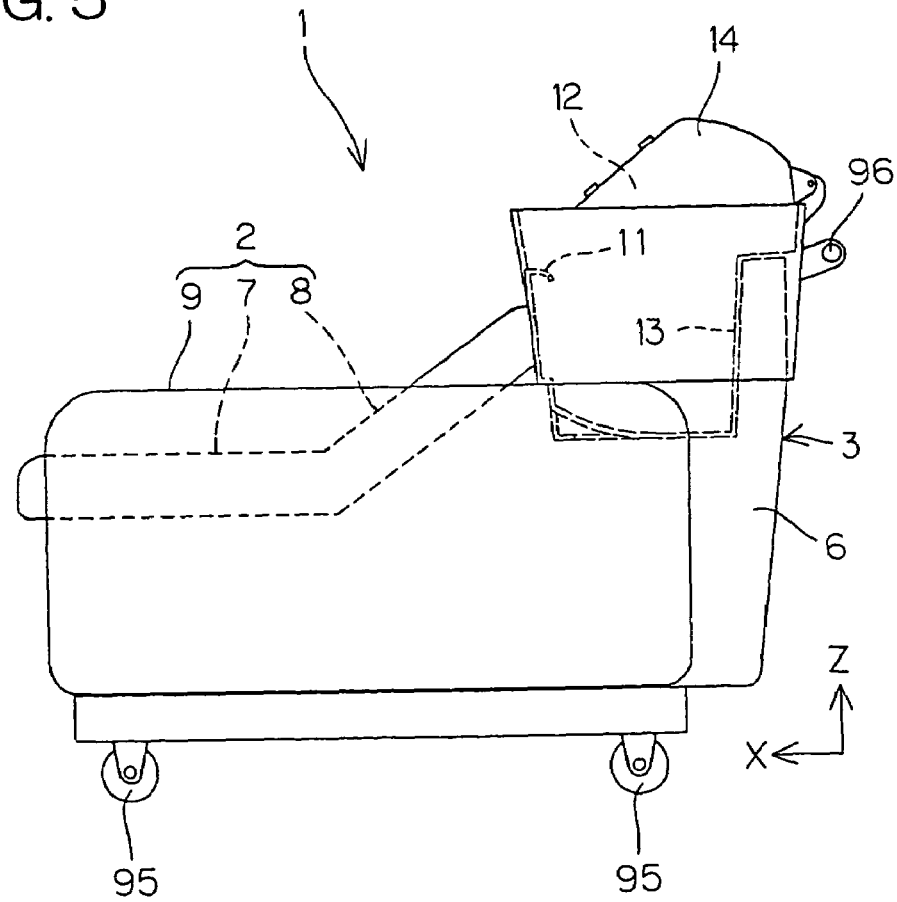
FIG. 5 is a side view of an automatic shampoo machine according to another embodiment of the present invention.

As shown in FIG. 5, the automatic shampoo machine 1 may further include, as transport means, a plurality of rotatable wheels 95 supported at four corners of the lower portion of the housing 3 and a bar 96 fixed to the rear portion of the housing 3 for pushing the automatic shampoo machine 1. Thus, the automatic shampoo machine 1 can easily be moved. In addition, it is not necessary to prepare a chair for the shampooing operation to be performed at a site to which the automatic shampoo machine is transported. The wheels 95 may be casters which are adapted to direct themselves in a direction in which they are pushed.

In this embodiment, the explanation is given mainly to components different in construction from those in the first embodiment. Components having the same construction as in the first embodiment are denoted by the same reference characters as in the first embodiment, and no explanation is given thereto. This definition will be applied to other embodiments.

According to another embodiment, the automatic shampoo machine may comprise a vibration mechanism 97 (indicated by a one-dot-and-dash line in FIG. 2) provided in the back-rest 8 of the seat 2 for massaging the back of the person. An inside space of the back-rest 8 of the seat 2 is effectively utilized for the provision of the vibration mechanism 97. Instead of the inside space of the back-rest 8, a rear space of the back-rest 8 of the seat 2 may be utilized. The vibration mechanism 97 has a known construction, and includes a member which vibrates while pressing the person's back to massage the back. The vibration mechanism 97 ensures comfortable shampooing together with the head massaging effect provided by the warm water spouted in the basin 13. The person being shampooed feels comfortable by the massaging by means of the vibration mechanism 97 and, therefore, hardly perceives noises occurring in the basin 13. Thus, perceivable noises can be reduced. A power source and the like for the components for the shampooing can be shared with the vibration mechanism 97, so that the construction can be simplified.

The operation panel 19 may include, as an operation member for the massaging, a key switch 16 for operating the vibration mechanism 97 and an indicator member 20 for indicating the state of the vibration mechanism.

In the aforesaid embodiment, the position adjusting mechanism 68 for adjusting the height of the seating portion 7 of the seat 2 along the inclination of the back-rest 8 is provided as the means for accommodating the variations in sitting height among persons to be shampooed but, instead, the following position adjusting mechanism 68 may be provided. For example, the position adjusting mechanism 68 may be constructed so that the seating portion 7 is movable in a direction intersecting the inclination axis of the back-rest 8 and the position of the seating portion 7 is adjustable anteroposteriorly and vertically.

Figure 6:
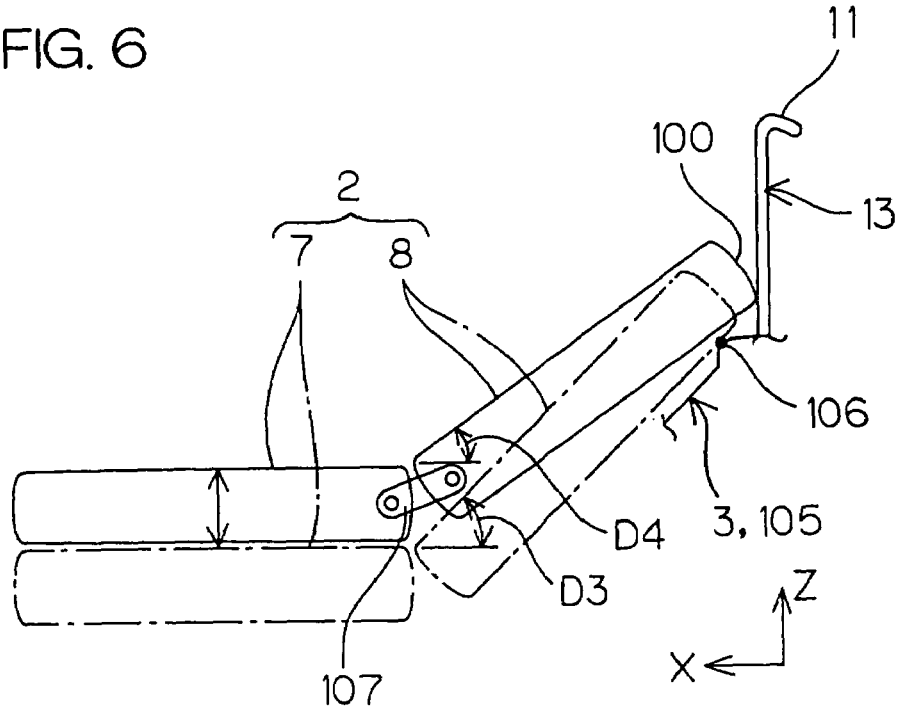
FIG. 6 is a side view for explaining the positional adjustment of a seat different from the seat shown in FIG. 4.

Alternatively, the position adjusting mechanism 68 may be constructed so that the seating portion 7 is movable only vertically for the height adjustment thereof as shown in FIG. 6.

Figure 7:
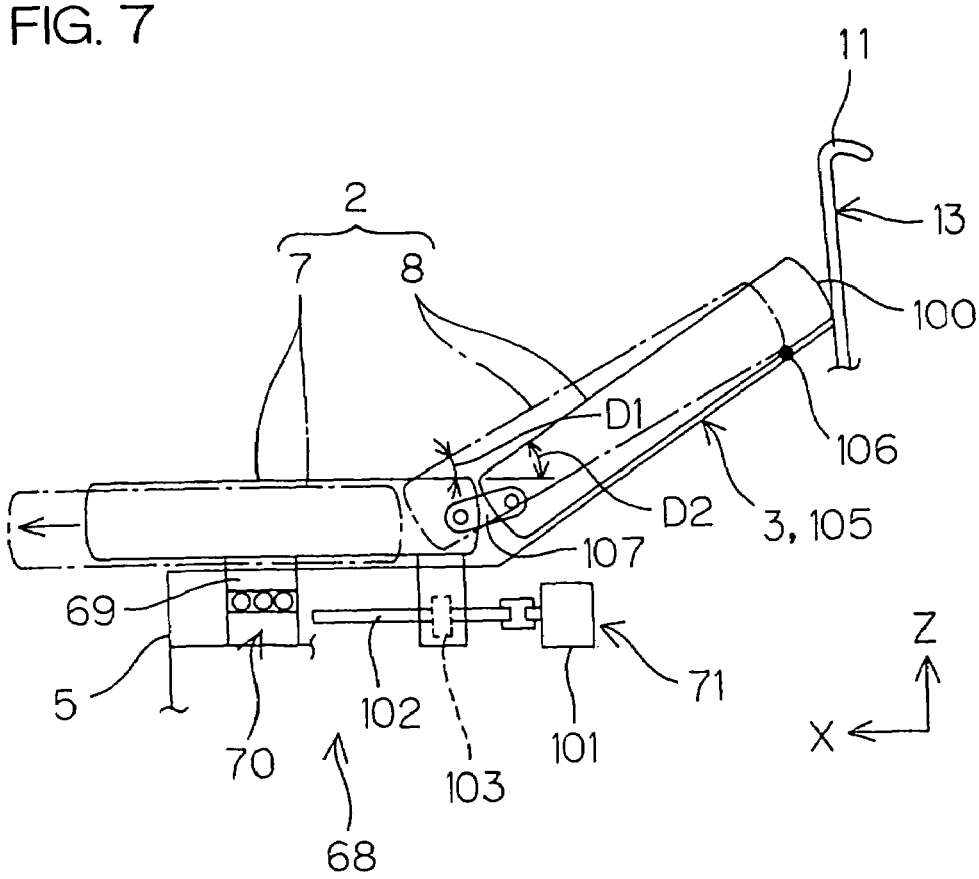
FIG. 7 is a diagram for explaining the positional adjustment of a seat different from the seats shown in FIGS. 4 and 6.

Further, the position adjusting mechanism 68 may be constructed so that the seating portion 7 is movable only anteroposteriorly for anteroposterior positional adjustment of the seating portion 7 as shown in FIG. 7. Even in this case, the variations in sitting height among persons to be shampooed can be accommodated, while ensuring that the person's neck is properly and assuredly positioned on the basin 13. Therefore, this is advantageous for the prevention of the water leakage.

In the case of the position adjusting mechanism 68 shown in FIG. 7, the base 69 is guided anteroposteriorly linearly in a relatively movable manner by the guide member 70. Thus, the seating position of the person on the seating portion 7 can be shifted anteroposteriorly with respect to the basin 13. Where the person to be shampooed has a greater sitting height, for example, the seating portion 7 is located at a relatively forward position.

In the embodiment shown in FIG. 4, the angle of the back-rest 8 is fixed, but this is not necessarily required. If the seating portion 7 is moved vertically with the position of the back-rest 8 being fixed, for example, there is a possibility that a step is formed between the seating portion 7 and the back-rest 8 to deteriorate the seating comfort on the seat 2. Therefore, the inclination angle of the back-rest 8 may be variable according to the positional adjustment of the seating portion 7 as shown in FIGS. 6 and 7. Thus, the formation of the step is suppressed, so that the seating comfort on the seat 2 can properly be maintained irrespective of the position of the seating portion 7.

When the inclination of the back-rest 8 is changed, the rear portion of the seating portion 7 and the lower portion of the back-rest 8 are positioned in alignment with each other. Thus, formation and expansion of a gap between the seating portion 7 and the back-rest 8 can be prevented. This is advantageous for properly maintaining the seating comfort.

In the embodiments shown in FIGS. 6 and 7, the lower portion of the back-rest 8 of the seat 2 is pivotally coupled to the rear portion of the seating portion 7 via a coupling member 107. An upper portion of the back-rest 8 is supported on a support portion 105 of the housing 3. A pivot axis 106 is defined along an abutment line along which the back-rest 8 abuts against the support portion 105, and the back-rest 8 is supported pivotally about the pivot axis 106.

As the seating portion 7 is moved, the lower portion of the back-rest 8 is moved via the coupling member 107, and the back-rest 8 is correspondingly pivoted about the pivot axis 106. In FIG. 6, the pivot axis 106 is located at a fixed position, and the entire back-rest 8 is inclined around the pivot axis 106. In FIG. 7, the position of the pivot axis 106 is shifted diagonally, and the entire back-rest 8 is inclined around the pivot axis 106. Where the seating portion 7 is anteroposteriorly moved for the adjustment as shown in FIG. 7, the inclination angle of the back-rest 8 is reduced with the forward movement of the seating portion 7 (angle D1<angle D2). Where the seating portion 7 is vertically moved for the adjustment as shown in FIG. 6, the inclination angle of the back-rest 8 is increased with the downward movement of the seating portion 7 (angle D3>angle D4).

In the embodiments of FIGS. 6 and 7, the back-rest 8 is adapted to be inclined according to the movement of the seating portion 7, but this is not necessarily required. What is important is that the inclination angle of the back-rest 8 is variable according to the position adjustment amount of the seating portion 7.

Figure 8:
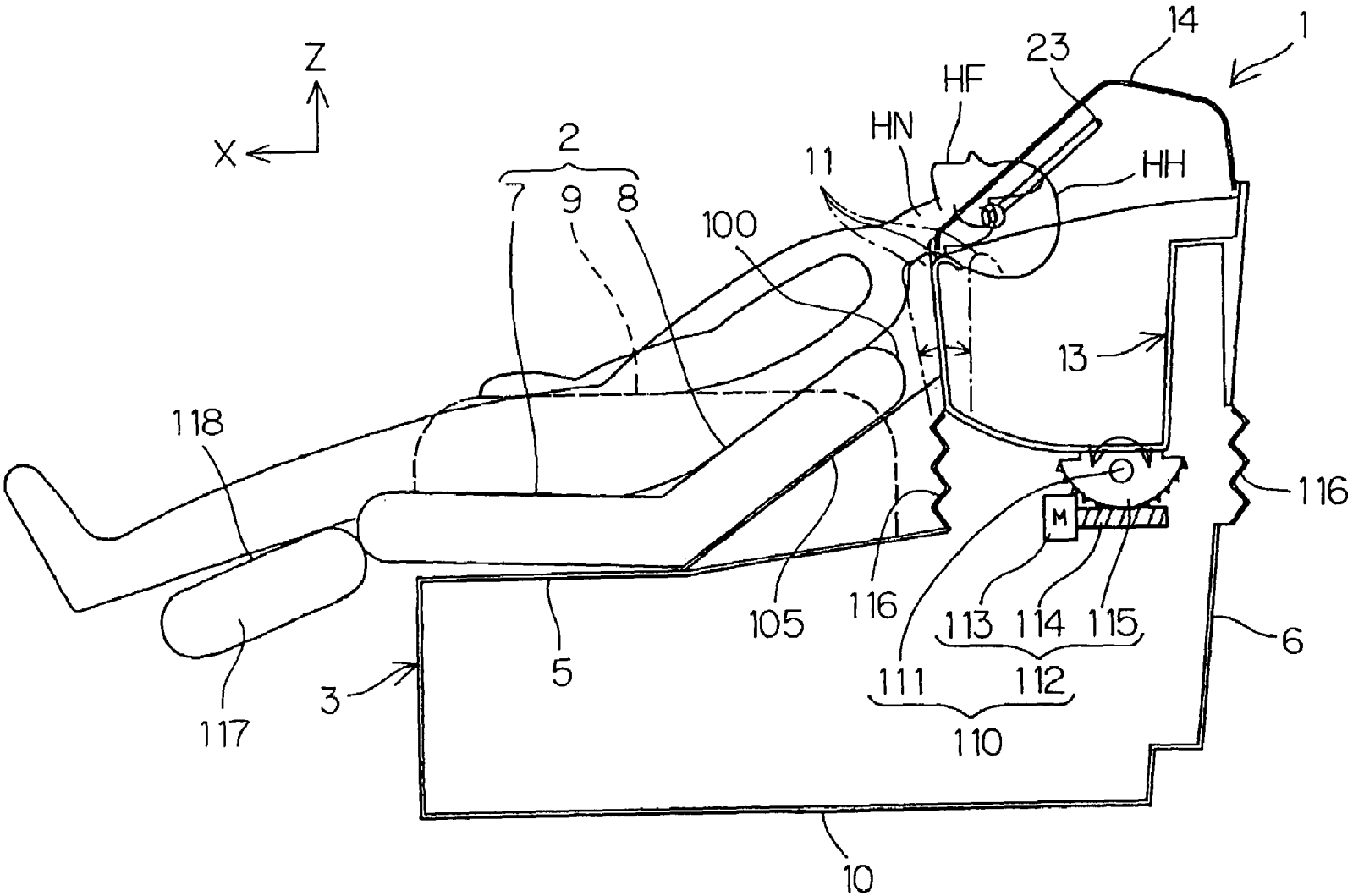
FIG. 8 is a side view schematically illustrating the construction of a basin position adjusting mechanism.

Further, a position adjusting mechanism 110 for adjusting the position of the basin 13 may be provided as the means for accommodating the variations in sitting height as shown in FIG. 8. With this arrangement, even where the position of the seat 2 is not variable, the variations in sitting height among persons to be shampooed can be accommodated, while ensuring that the person's neck can properly be positioned on the neck-rest 11 of the basin 13. Therefore, this arrangement is advantageous for the prevention of the water leakage.

The position adjusting mechanism 110 adjusts the position of the top opening 12 of the basin 13 anteroposteriorly by adjusting the inclination of the basin 13. The position adjusting mechanism 110 has a support shaft 111 provided on a bottom rear portion of the basin 13. The support shaft 111 is pivotally supported by the housing 3 as extending laterally. The basin 13 can be inclined anteroposteriorly about the axis of the support shaft 111. A drive mechanism 112 for inclining the basin 13 is provided below the basin 13. The drive mechanism 112 includes a motor 113, a worm shaft 114 co-rotatable with a rotation shaft of the motor 113, and a fan-shaped worm wheel 115 meshed with the worm shaft 114. The worm wheel 115 is fixed to the basin 13, and disposed coaxially with the support shaft 111. When the motor 113 is driven, the worm wheel 115 and the basin 13 are pivoted about the axis of the support shaft 111, whereby the basin 13 is inclined. Thus, the neck-rest 11 on the opening 12 of the basin 13 is movable anteroposteriorly as well as vertically.

The center of a range of the inclination adjustment of the basin 13 is determined on the basis of an inclination to be assumed by a person having an average sitting height, and preferably determined so that the neck-rest 11 is located at the highest position when the neck-rest 11 is inclined for a person having the greatest conceivable sitting height. Thus, the neck can easily be positioned on the neck-rest 11.

The neck-rest 11 on the opening 12 of the basin 13 may be adapted to be moved along a path generally coinciding with the inclination of the back-rest 8 as the basin 13 is inclined. This arrangement is advantageous for keeping the person in an attitude suitable for the shampooing.

A flexible cover 116 which is deformable according to the inclination of the basin 13 to cover the periphery of the basin 13 is provided around the basin 13. The cover 116 is composed, for example, of a resilient rubber material, and has a bellow-like shape. The cover 116 suppresses leakage of noises occurring in the automatic shampoo machine 1 to the outside, and prevents intrusion of foreign matter such as water droplets and dust in the automatic shampoo machine from the outside. The back-rest 8 of the seat 2 has a small length, and a gap is defined between the rear edge 100 of the back-rest 8 and the front portion of the basin 13 to allow for the movement of the basin 13.

Since the basin 13 is inclinable, the arrangement for the positional adjustment of the basin 13 can be simplified.

Besides the arrangement for inclining the basin 13, another conceivable arrangement for the positional adjustment of the opening 12 of the basin 13 with respect to the seat 2 is to linearly slide the basin 13 vertically, anteroposteriorly or diagonally while maintaining the attitude of the basin 13. Where the position of the opening 12 of the basin 13 is adjustable, the seating portion 7 of the seat 2 may be provided in a positionally adjustable manner or at a fixed position.

Figure 9:
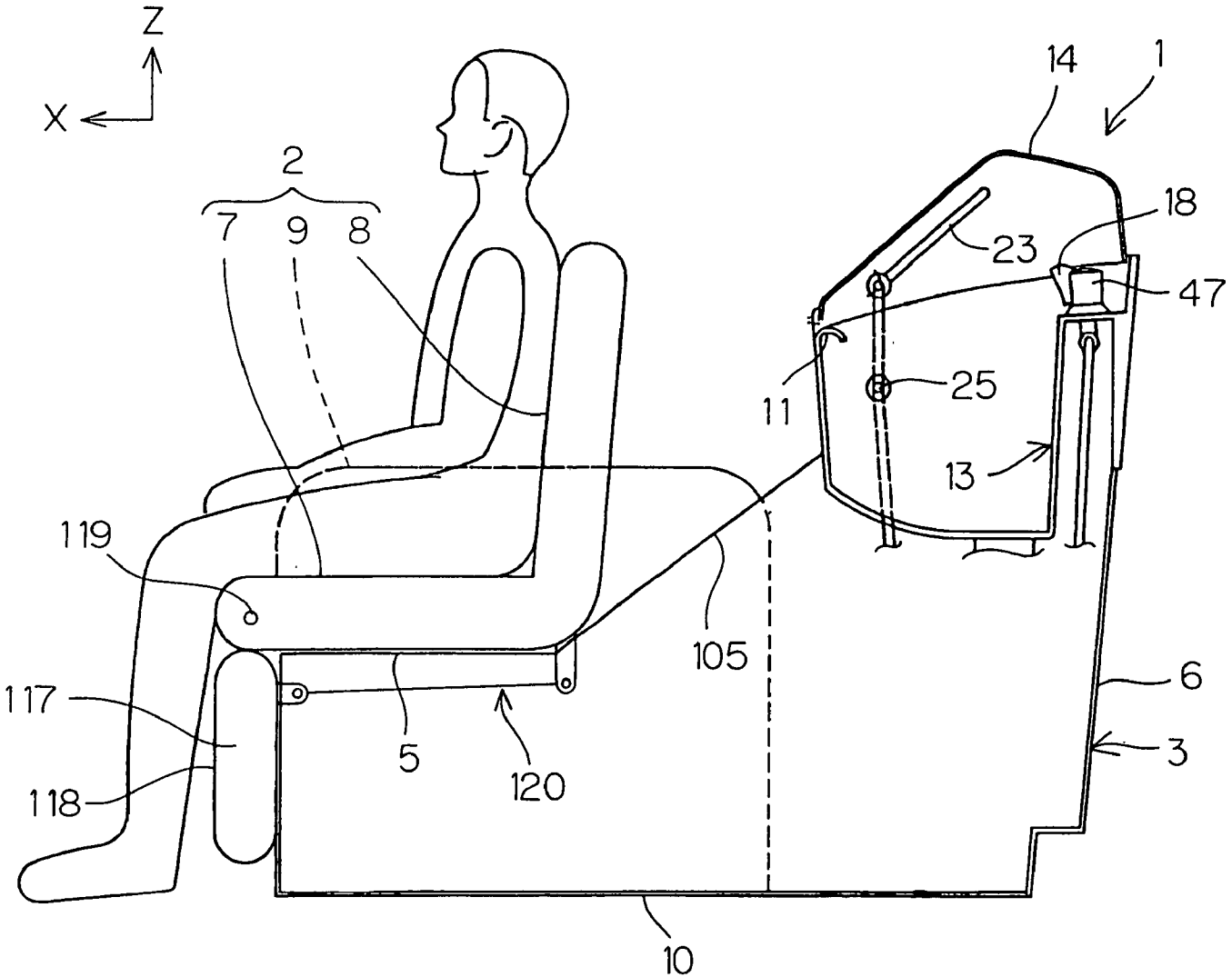
FIG. 9 is a side view illustrating a seat in an upright state for explaining a back-rest reclining function of the seat.
Figure 10:
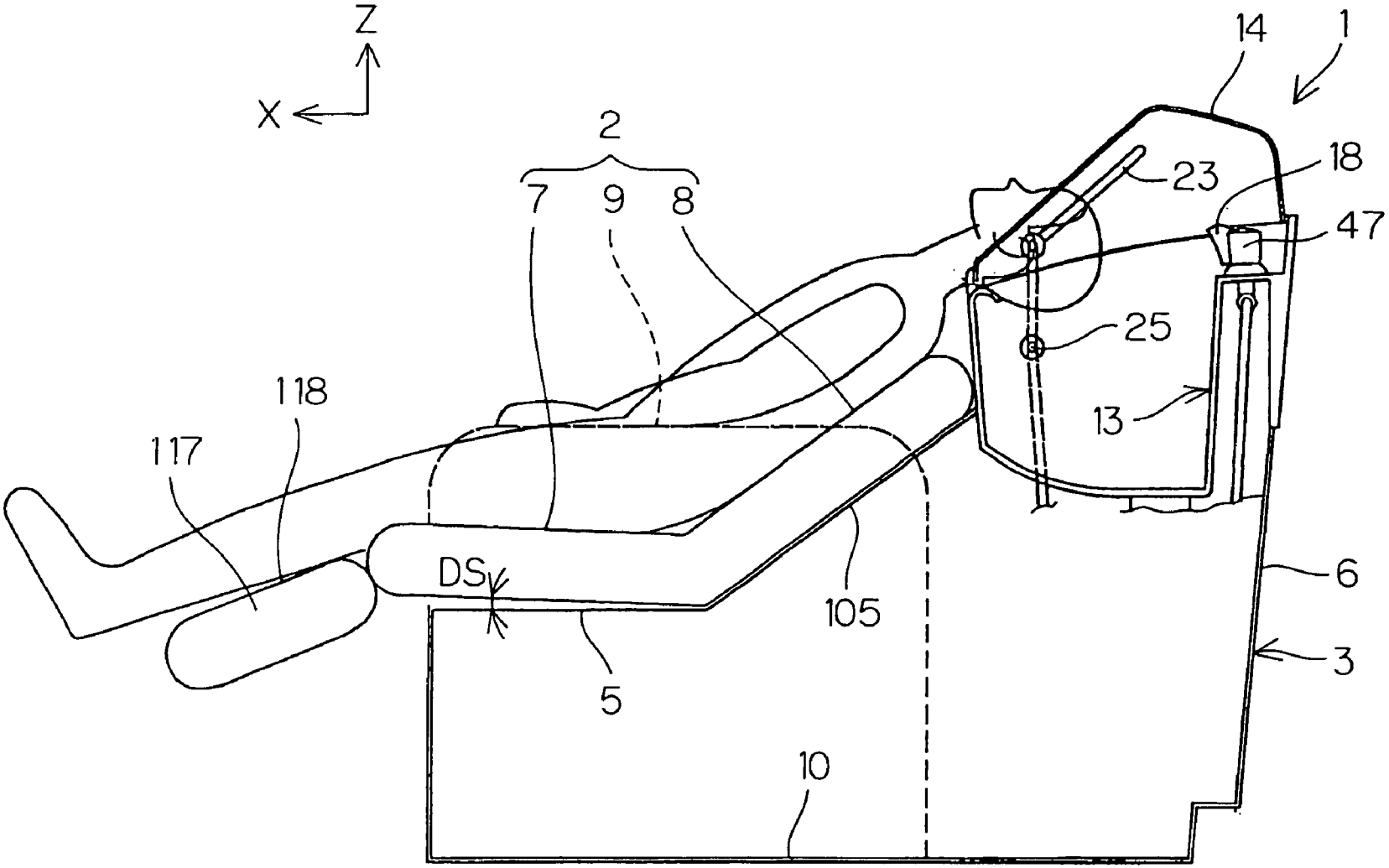
FIG. 10 is a side view illustrating the seat in a reclined state for explaining the back-rest reclining function of the seat.

Further, the back-rest 8 of the seat 2 may be adapted to be raised upright from the seating portion 7 and reclined rearward as shown in FIGS. 9 and 10. The back-rest 8 is switchable between an upright state in which it projects generally vertically from the seating portion 7 and a reclined state in which it is reclined from the upright state.

Though not shown, the back-rest 8 is provided with a support mechanism for supporting the back-rest 8 pivotally about the axis of a support shaft provided below the back-rest 8 assuming the upright state, and an arresting mechanism for releasably arresting the back-rest 8 in the reclined state and in the upright state. The back-rest 8 may be adapted to be reclined by a power-driven mechanism including a motor, reduction gears and the like, or via reduction gears by manually rotating a handle. Alternatively, the back-rest 8 may be adapted to be manually reclined with the use of a handle fixed to the back-rest 8. A known arrangement may be employed for the reclining of the back-rest 8.

On the back-rest 8 in the upright state, the person assumes an upright attitude as shown in FIG. 9. On the back-rest 8 in the reclined state, the person assumes a supine attitude when reclining on the back-rest 8 as shown in FIG. 10, and is shampooed in this attitude.

By reclining the back-rest 8, the person can smoothly be brought into the supine attitude for the shampooing. That is, the person to be shampooed sits on the seat 2 with the back-rest 8 kept in the upright state before the shampooing. As the back-rest 8 is reclined, the person is smoothly brought into the supine attitude while being guided reclining on the back-rest 8. After the shampooing, the back-rest 8 is raised, whereby the person is smoothly raised on the back-rest 8. At this time, a burden on the person for sitting up can be alleviated where the back-rest 8 is power-driven.

The seat 2 may be provided with a leg-rest 117 for receiving the legs of the person seated on the seating potion 7.

The leg-rest 117 has a resting surface 118 for receiving the person's legs rested thereon. The leg-rest 117 is switchable between a resting state (see FIG. 10) to be assumed when the person rests the legs thereon during the shampooing and a retracted state (see FIG. 9) to be assumed when the person sits down to be seated on the seat 2 or stands up to leave the seat 2. In the resting state, the resting surface 118 is inclined so as to be oriented rather forwardly upward, and located forwardly of the seating portion 7 downwardly of the seating surface of the seating portion 7. Therefore, the person seated on the seat 2 can comfortably rest the legs on the leg-rest. In the retracted state, the resting surface 118 is oriented forward and located downwardly of the seating portion 7 so as not to interfere with the person. Thus, the person can easily stand up from the seat.

As shown in FIG. 9, a support shaft 119 is provided above the leg-rest 117 in the retracted state for switching the state of the leg-rest 117. The leg-rest 117 is supported by the housing 3 pivotally about the axis of the support shaft 119. The leg-rest 117 and the back-rest 8 are coupled in association with each other by a coupling mechanism 120. The coupling mechanism 120 pivots the leg-rest 117 in association with the movement of the back-rest 8. A known mechanism such as a link mechanism may be employed as the coupling mechanism 120 for coupling the leg-rest 117 and the back-rest 8.

When the back-rest 8 is in the upright state, the leg-rest 117 is in the retracted state. As the back-rest 8 is reclined rearward from the upright state, a lower portion of the leg-rest 117 is raised to project forward, whereby the resting surface 118 is oriented upward. When the back-rest 8 is in the reclined state, the leg-rest 117 is in the resting state. As the back-rest 8 is raised from the reclined state, the leg-rest 117 is pivoted to be retracted below the seating portion 7.

The seating surface of the seating portion 7 may be inclined (at an angle DS in FIG. 10) according to the reclining of the back-rest 8. A known mechanism such as a link mechanism or a gear mechanism may be employed as a mechanism for inclining the seating portion 7. When the back-rest 8 is in the upright state, the seating surface of the seating portion 7 is held generally horizontal, so that the person can easily sit down on the seating portion 7 and stand up from the seating portion 7. When the back-rest 8 is in the reclined state, the seating portion 7 is inclined rearwardly downward. Thus, the person is less liable to slip down from the seat 2 when the person reclines on the inclined back-rest 8. Therefore, the positional relationship between the person's neck and the basin 13 is prevented from being varied during the shampooing.

The aforesaid embodiments of the automatic shampoo machine 1 integrally provided with the seat 2, i.e., the embodiments related to the construction of the housing 3, the angle of the back-rest 8 of the seat 2, the arrangement for accommodating the variations in sitting height, the transport means, the massaging function, the layout of the operation panel 19, the arrangement for reclining the back-rest 8, the leg-rest 117 and the inclination of the seating portion according to the inclination of the back-rest 8, may be employed either alone or in combination.

The spout means 4 includes the warm water reservoir tank 45, but this is not necessarily required. For example, the spout means may be adapted to supply warm water directly from the outside to the pump 59 without the provision of the warm water reservoir tank 45. Further, the spout means may be constructed so that the warm water stored in the warm water reservoir tank 45 is utilized for the shampooing without replenishment of warm water during the shampooing and water used for the shampooing is drained to be stored in an internal drain tank (not shown), thereby obviating the connection of the hot water pipe 33, the water supply pipe 32 and the external drain channel.

Further, the upper nozzles 24 and the lower nozzles 26 are not necessarily required to be provided on the movable nozzle links, but all the nozzles may be provided as fixed nozzles (whose warm water spouting direction may be adjustable) on the peripheral wall of the basin 13. Warm water may be supplied to the fixed nozzles via a common pipe and valve or, alternatively, through a corresponding number of branch pipes provided with valves.

Figure 11:
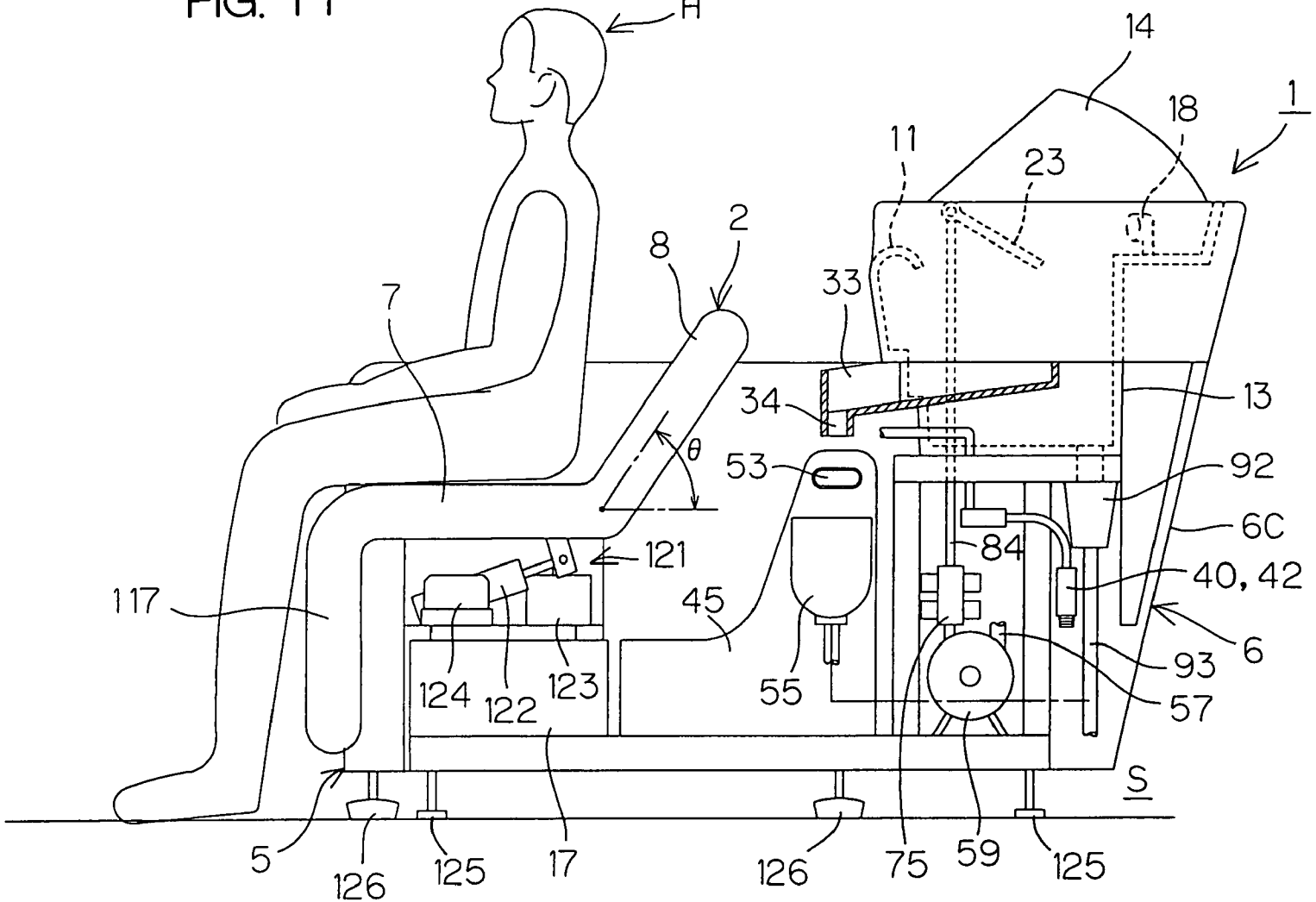
FIG. 11 is a schematic sectional view illustrating the internal construction of the automatic shampoo machine according to further another embodiment of the present invention.

FIG. 11 is a schematic sectional view illustrating the internal construction of an automatic shampoo machine 1 according to further another embodiment of the present invention. The following explanation will be based on the assumption that the left-hand side and the right-hand side in FIG. 11 respectively correspond to the forward side and rear side of the automatic shampoo machine.

Referring to FIG. 11, the automatic shampoo machine 1 includes a basin retaining part 6 which retains a basin 13 for receiving the head of a person H to be shampooed when a shampooing operation is performed, and a seat retaining part 5 which retains a seat 2 provided in front of the basin retaining part 6 for seating the person H thereon.

An arrangement for supplying warm water to a shampooing section including the basin 13 has substantially the same construction as in the first embodiment. Components equivalent or corresponding to those in the first embodiment are denoted by the same reference numerals, and no explanation will be given thereto.

A leak water receiving member 33 for receiving cleaning water which happens to be leaked out of the basin 13 through a gap formed between the neck of the person H and a neck-rest 11 during the shampooing is provided in front of the peripheral wall of the basin 13. The bottom of the leak water receiving member 33 is inclined forwardly downward, and a drain port 34 is provided at the lowest position of the bottom. The drain port 34 faces a drain pan 55.

The seat 2 is constituted, for example, by a single soft and resilient seat member. The seat 2 is produced by bending the seat member, and includes a seating portion 7 on which the person H is seated, a back-rest 8 extending upward from the seating portion 7, and a leg-rest 117 extending downward from a side of the seating portion 7 opposite from the back-rest 8. The seating portion 7, the back-rest 8 and the leg-rest 117 may be separately provided, and the leg-rest 117 may be obviated.

The back-rest 8 of the seat 2 is located on the side of the basin 13. When the shampooing operation is performed, the person H is seated on the seat 2 with the person's back oriented toward the basin 13. In an initial state, the inclination angle θ of the back-rest 8 with respect to the extension of the seating portion 7 (extending generally horizontally) is set, for example, at 55 degrees. The back-rest 8 is reclined rearward at an inclination angle θ of 35 degrees with a hood 14 pivoted rearward to open an upper portion of the basin 13, whereby the person H assumes a supine attitude. Thus, the person's head is inserted in the basin 13 with the person's neck rested on the neck-rest 11.

After the head of the person H is inserted in the basin 13, the hood 14 is closed so that the person's face is exposed out of the hood. Thereafter, the leg-rest 117 is pivoted upward, whereby the legs (leg portions between knees and ankles) of the person H are supported on the leg-rest 117. Thus, the person H can be shampooed in a comfortable attitude with the person's legs stretched (see FIG. 16).

A seat adjusting mechanism 121 for adjusting the antero-posterior position of the seat 2, the height of the seating portion 7, the inclination angle θ of the back-rest 8, the inclination angle of the leg-rest 117 and the like is disposed below the seating portion 7 of the seat 2. The seat adjusting mechanism 121 is, for example, a hydraulically driven mechanism, which includes a hydraulic cylinder 122 as an actuator, a hydraulic tank 123 containing an operating oil to be supplied to the hydraulic cylinder 122, and a hydraulic pump 124 for pumping the operating oil from the hydraulic tank 123 into the hydraulic cylinder 122. However, the seat adjusting mechanism 121 is not limited to the hydraulically driven type, but may be of an electrically driven type.

A feature of this embodiment is that the basin retaining part 6 which retains the basin 13 and the seat retaining part 5 which retains the seat 2 are detachable. That is, front and rear portions of the housing 3 are separable from each other.

Figure 12:
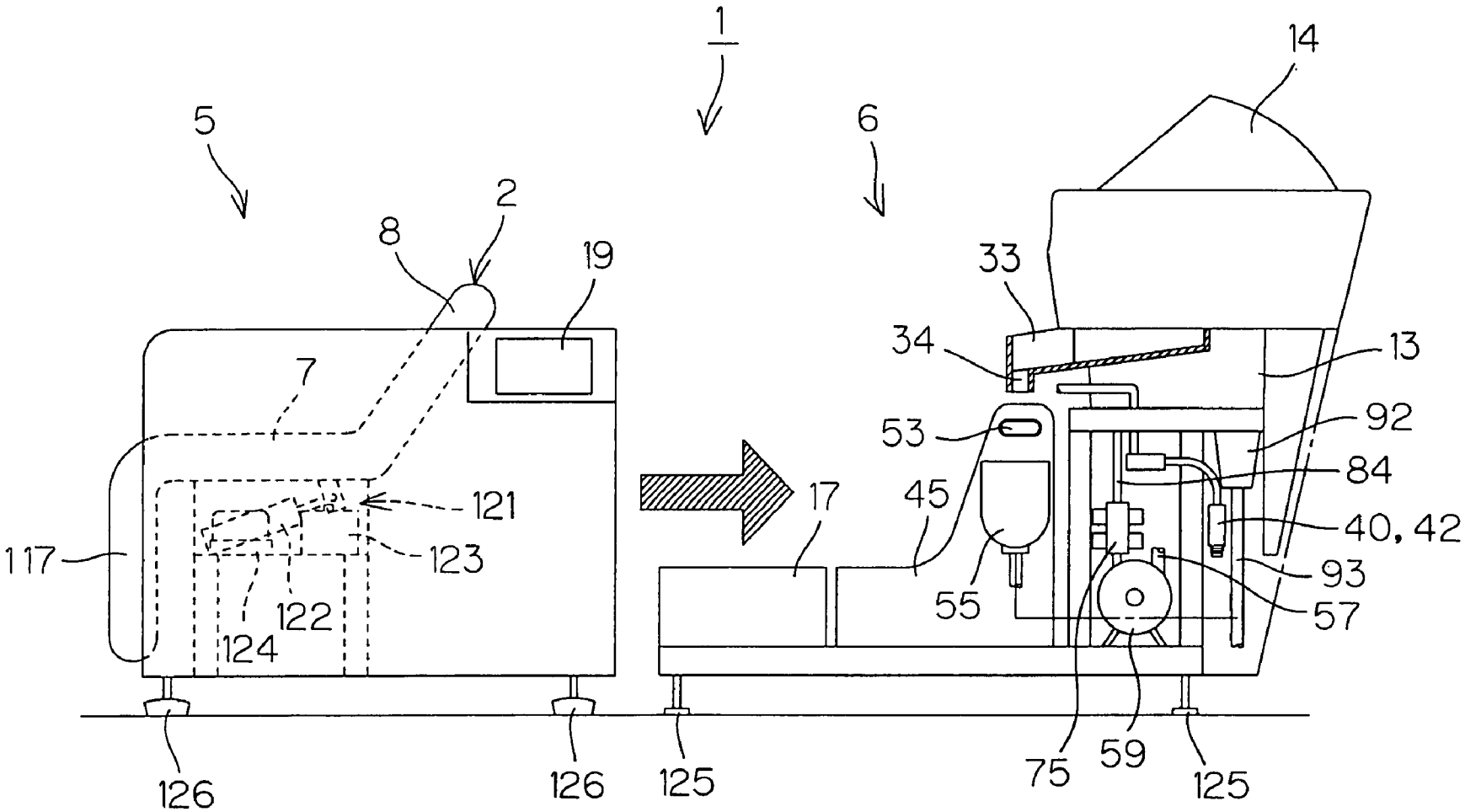
FIG. 12 is a side view illustrating a basin retaining part and a seat retaining part separated from each other.

FIG. 12 is a side view illustrating the basin retaining part 6 and the seat retaining part 5 separated from each other.

Referring to FIG. 12, the basin retaining part 6 retains a water supply mechanism, a warm water reservoir tank 45, an electrical component box 17 and a drain pan 55 in addition to the basin 13. On the other hand, the seat retaining part 5 retains the seat adjusting mechanism 121 in addition to the seat 2. The basin retaining part 6 and the seat retaining part 5 are each supported by four legs 125, 126 (two legs for each part are seen in FIG. 12).

When the basin retaining part 6 and the seat retaining part 5 are to be combined together, the basin retaining part 6 is first located at a predetermined installation position, and then the seat retaining part 5 is slid rearward from the front side of the basin retaining part 6, whereby the seat retaining part 5 is engaged with the basin retaining part 6 so as to cover the respective components (the water supply mechanism, the warm water reservoir tank 45, the electrical component box 17 and the drain pan 55) retained in the basin retaining part 6.

After the seat retaining part 5 is engaged with the basin retaining part 6, the seat retaining part 5 and the basin retaining part 6 are positioned with respect to each other by connecting the basin retaining part 6 with the seat retaining part 5, for example, by a fixture not shown, so that the basin 13 and the seat 2 are located in a predetermined close positional relationship (see FIG. 11). As shown in FIG. 11, the electrical component box 17 is accommodated in a space below the seat adjusting mechanism 121 with the seat retaining part 5 and the basin retaining part 6 combined together.

An operation panel 19 for starting the operation of the automatic shampoo machine 1 and inputting various other settings is provided on a rear upper portion of a right side face (a forward face as seen in FIG. 12) of the seat retaining part 5. Thus, the operation panel 19 is located at a position which is inaccessible by the person H during the shampooing operation. The operator stands on a rear right side of the automatic shampoo machine 1 (on the right side of the basin 13) and operates the operation panel 19 to perform an automatic shampooing operation.

The legs 125, 126 may each comprise a caster. Particularly where the legs 126 of the seat retaining part 5 each comprise a caster, the seat retaining part 5 can be slid toward the basin retaining part 6 with a relatively small magnitude of force so as to be combined with the basin retaining part 6. Thus, the combining operation can be facilitated.

Figure 13:
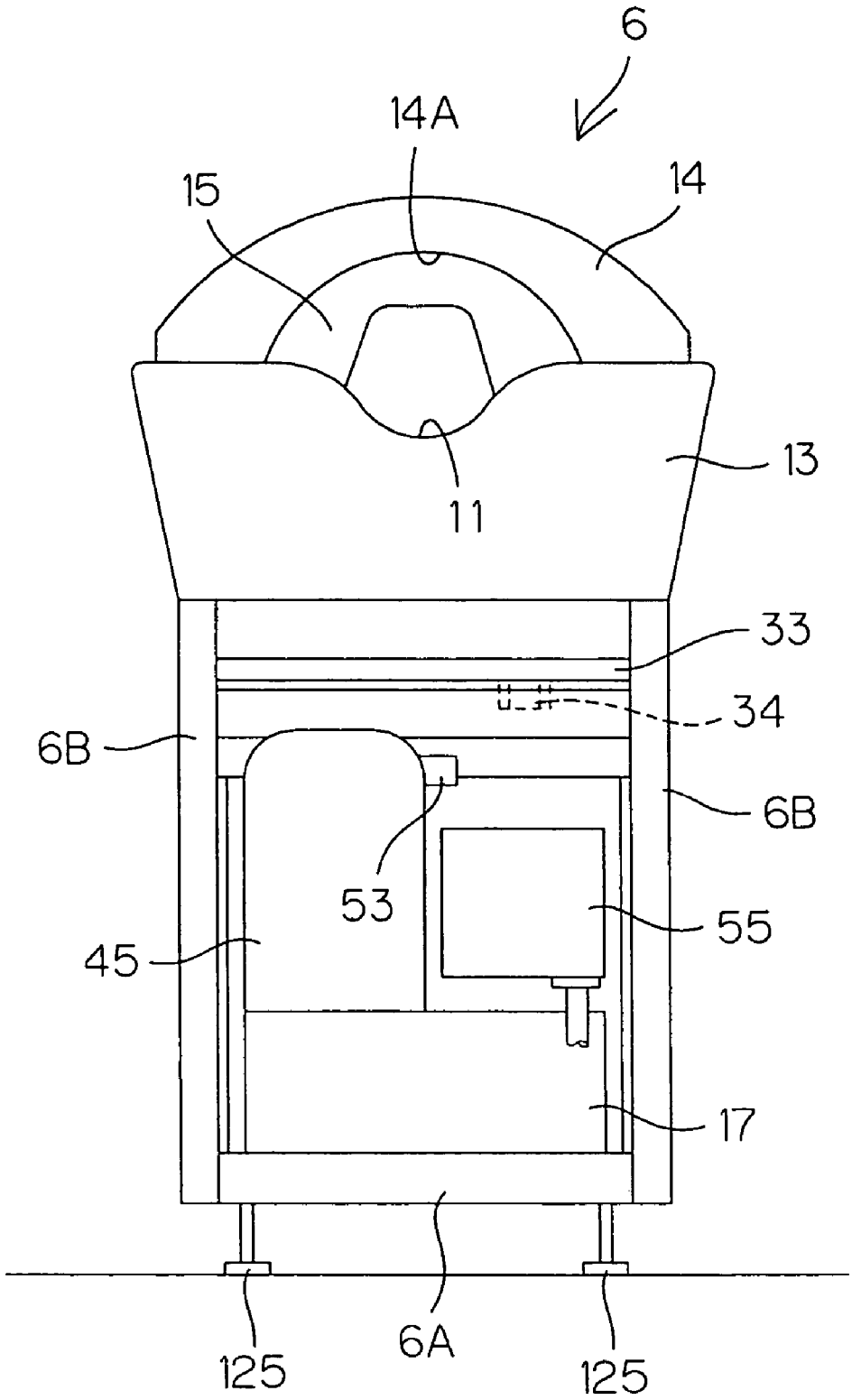
FIG. 13 is a front view illustrating the exterior of the basin retaining part.

FIG. 13 is a front view illustrating the exterior of the basin retaining part 6.

As shown in FIG. 13, the bottom of the basin retaining part 6 is constituted by a frame 6A. Side plates 6B for covering the right and left sides of the water supply mechanism are attached to the right and left sides of the frame 6A. The warm water reservoir tank 45 has an elongated shape, and the drain pan 55 is disposed in a space on the right side of the warm water reservoir tank 45.

The hood 14 has a cut-away portion 14A provided on the front side of a lower edge thereof for exposing the face of the person H therefrom. A face seal 15 to be brought into abutment against the periphery of the face of the person H is attached to the edge of the cut-away portion 14A for preventing water from splashing out of the basin 13 to the outside during the shampooing. The face seal 15 is preferably composed of a soft and flexible material.

Figure 14:
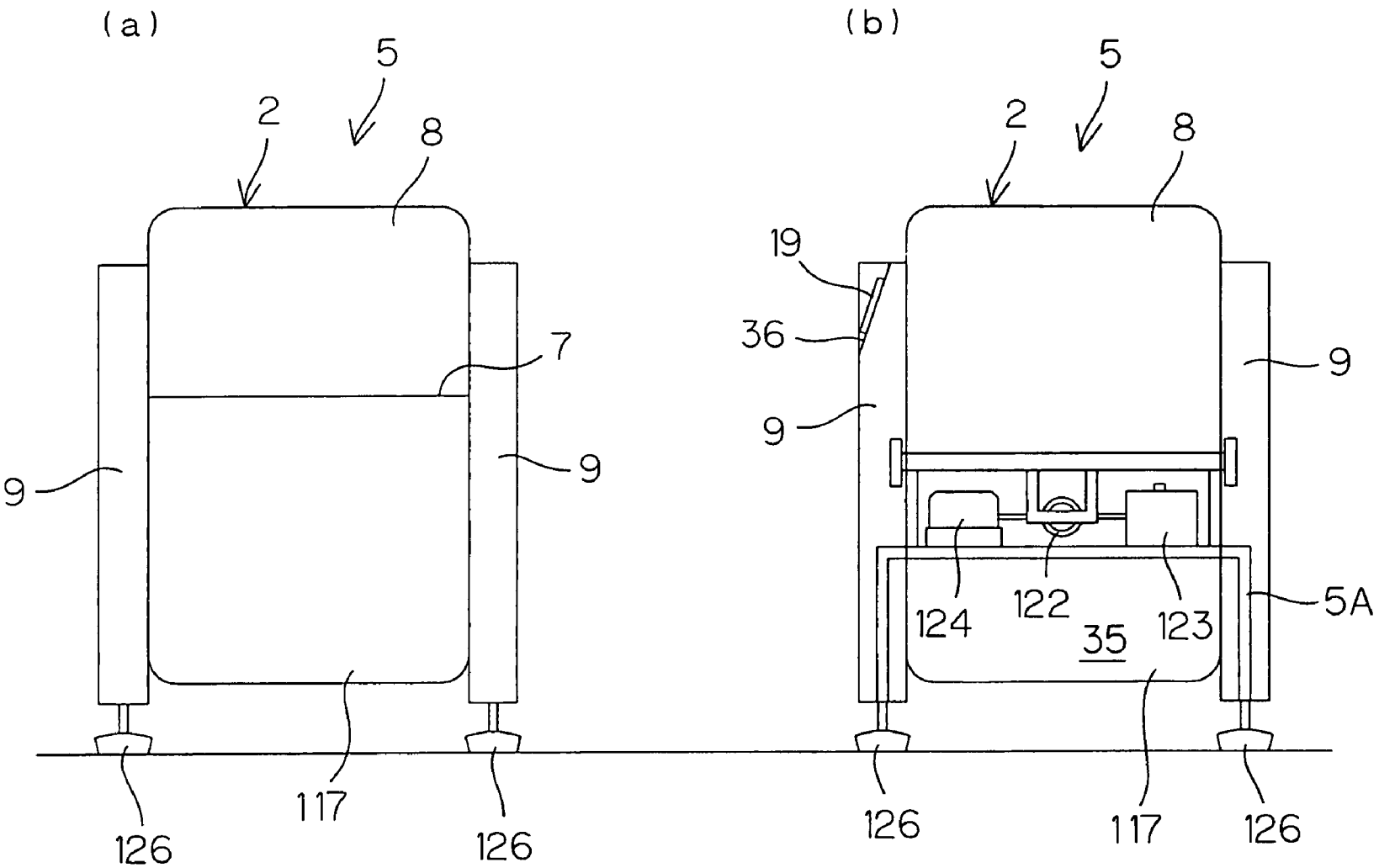
FIG. 14 are diagrams illustrating the exterior of the seat retaining part.

FIG. 14 are diagrams illustrating the exterior of the seat retaining part 5. FIGS. 14(*a*) and 14(*b*) are a front view and a back view, respectively.

As shown in FIG. 4, arm-rests 9 for receiving arms of the person H rested thereon are provided on right and left sides of the seat 2. These arm-rests 9 respectively define right and left side faces of the seat retaining part 5.

The bottom of the seat retaining part 5 is constituted by a frame 5A bent in a generally open-square shape, and the legs 126 are attached to opposite edges of the frame 5A. A space defined between the frame 5A and the floor serves as an insertion space 35 which receives the basin retaining part 6 inserted therein. The insertion space 35 is dimensioned so that, for example, clearances (engagement clearances) of about 5 mm are defined between the basin retaining part 6 and the frame 5A on the right and left sides when the basin retaining part 6 is inserted therein.

The right arm-rest 9 has an oblique surface 36 provided on a rear upper portion thereof and mounted with the operation panel 19. The operation panel 19, which is mounted on the oblique surface 36, is inclined at a predetermined angle (e.g., 30 degrees to 60 degrees) with respect to a vertical plane. Therefore, the operator standing on the right rear side of the automatic shampoo machine 1 can easily operate the operation panel 19.

Figure 15:
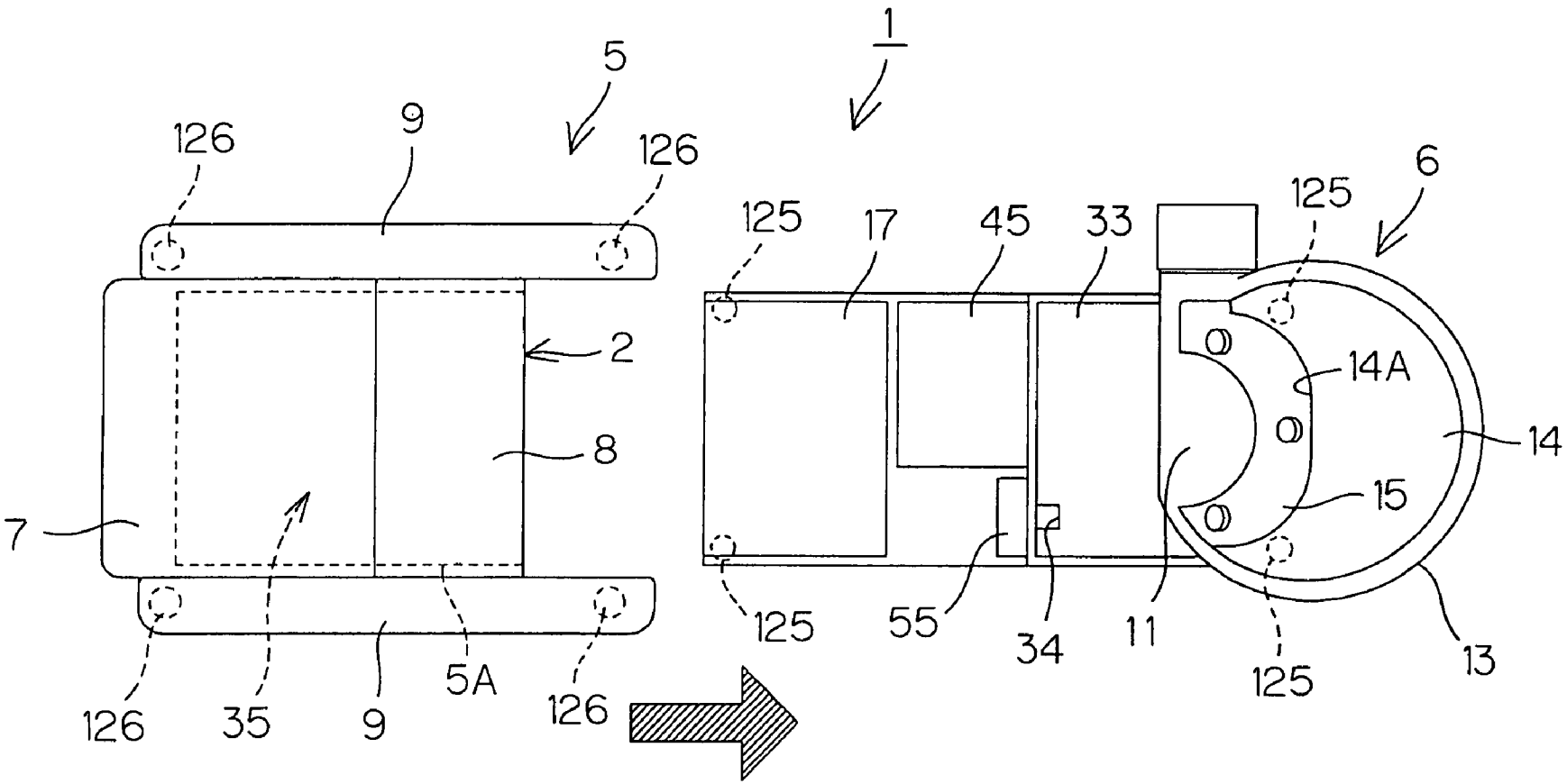
FIG. 15 is a plan view illustrating the basin retaining part and the seat retaining part separated from each other.

FIG. 15 is a plan view illustrating the basin retaining part 6 and the seat retaining part 5 separated from each other.

As shown in FIG. 15, the arm-rests 9 are attached to the frame 5A as projecting rearward. Therefore, when the seat retaining part 5 is slid toward the basin retaining part 6 so as to be combined with the basin retaining part 6, the basin retaining part 6 is inserted into a space between the right and left arm-rests 9. By further sliding the seat retaining part 5, the basin retaining part 6 is inserted into the insertion space 35 surrounded by the frame 5A.

In this embodiment, the right and left arm-rests 9 serve as a guide when the seat retaining part 5 is slid toward the basin retaining part 6 so as to be combined with the basin retaining part. Therefore, the seat retaining part 5 and the basin retaining part 6 can easily be combined together.

The arrangement for engaging the seat retaining part 5 with the basin retaining part 6 according to this embodiment improves the unitization of the basin retaining part 6 and the seat retaining part 5. Instead of the arrangement in which the seat retaining part 5 is engaged with the basin retaining part 6 as covering the basin retaining part from the outside, the basin retaining part may cover the seat retaining part from the outside. In this case, the arm-rests may be attached to the basin retaining part.

Figure 16:
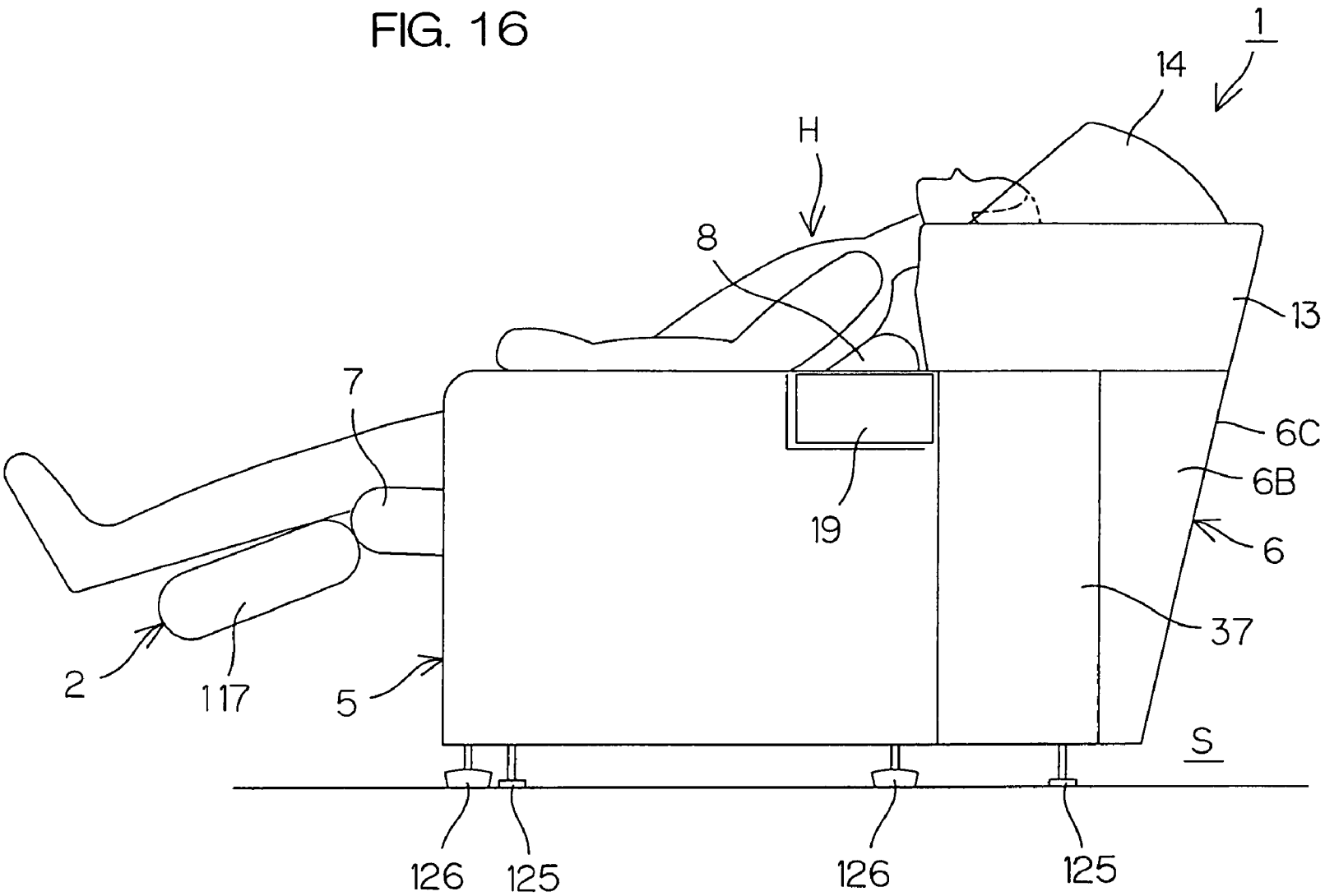
FIG. 16 is a side view illustrating the assembled automatic shampoo machine in use.

FIG. 16 is a side view illustrating the assembled automatic shampoo machine 1 in use.

As described above, the sufficient clearances are provided between the basin retaining part 6 and the seat retaining part 5 combined together. Therefore, gaps defined between the seat retaining part 5 and the basin retaining part 6 combined together are seen from the outside, thereby deteriorating the appearance.

In this embodiment, exterior panels 37 are provided on the right and left sides for hiding the gaps defined between the basin retaining part 6 and the seat retaining part 5 combined together (only a right exterior panel 37 is seen in FIG. 16). With this arrangement, the gaps between the basin retaining part 6 and the seat retaining part 5 are hidden, so that the appearance can be improved. Further, the unitization of the basin retaining part 6 and the seat retaining part 5 can further be improved.

In this embodiment, the basin retaining part 6 has a rear face 6C which is inclined downward toward the seat 2, and a free space S is defined on the rear lower side of the automatic shampoo machine 1. In this embodiment, the electrical component box 17 is accommodated below the seat 4, so that the components (the water supply mechanism, the warm water reservoir tank 45 and the like) provided below the basin 13 are located correspondingly closer to the seat 2 (on the forward side). Therefore, the free space S can sufficiently be afforded. With this arrangement, the operator can insert the feet in the free space S to more approach the person H when manually shampooing the person H from the rear side of the automatic shampoo machine 1. Thus, the shampooing operation is facilitated.

Figure 17:
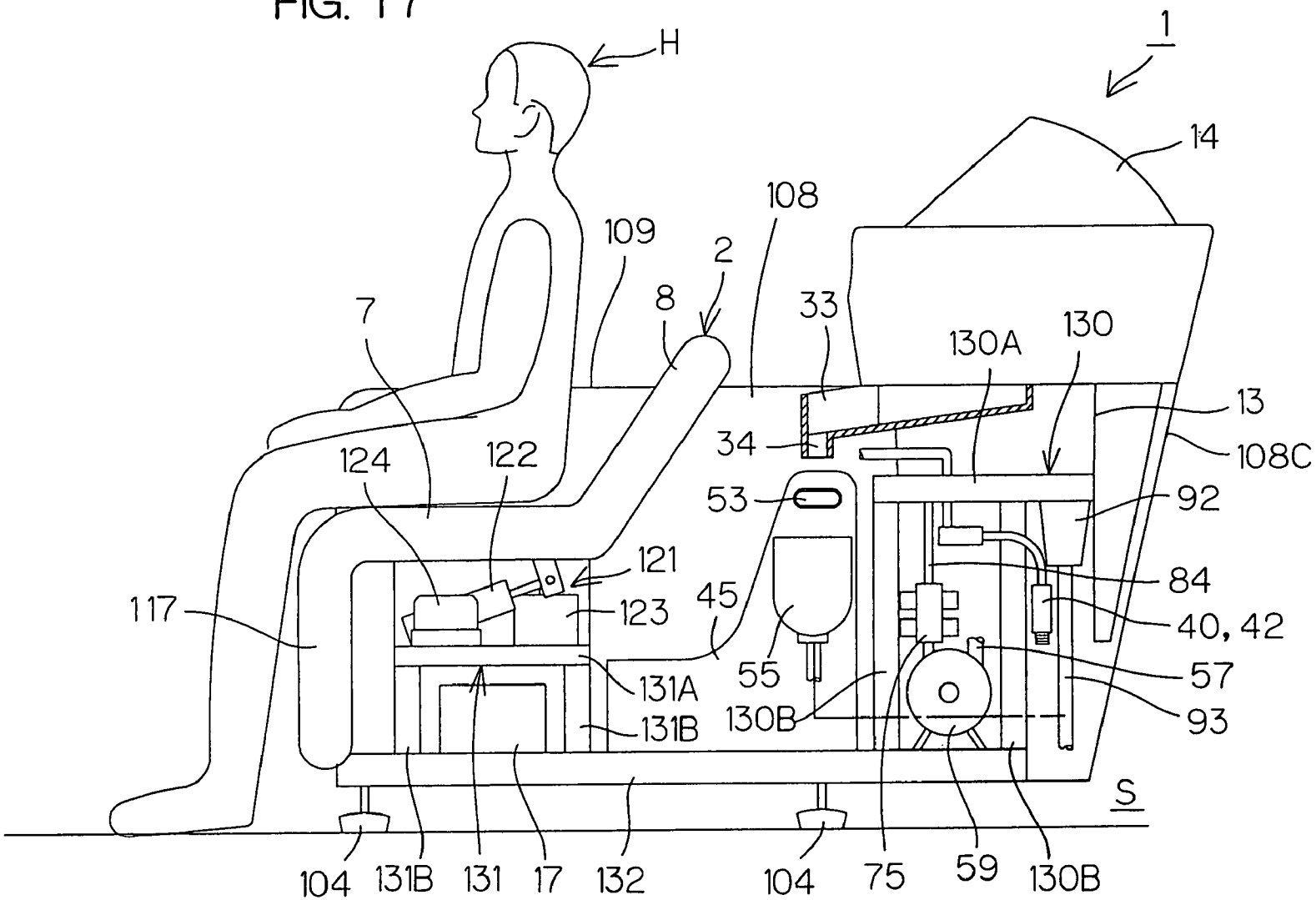
FIG. 17 is a schematic sectional view illustrating the internal construction of an automatic shampoo machine according to still another embodiment of the present invention.

FIG. 17 is a schematic sectional view illustrating the internal construction of an automatic shampoo machine 1 according to still another embodiment of the present invention.

Referring to FIG. 17, the automatic shampoo machine 1 includes a water supply mechanism, a warm water reservoir tank 45, an electrical component box 17, a drain pan 55, a seat adjusting mechanism 121 and the like in addition to a basin 13 and a seat 2.

A feature of this embodiment is that the positioning of the basin 13 and the seat 2 is achieved by connecting a basin retaining base 130 for retaining the basin 13 with a seat retaining base 131 for retaining the seat 2 by means of a frame 132 constituting the bottom of the automatic shampoo machine 1, rather than by engaging the basin retaining part 6 with the seat retaining part 5 as in the preceding embodiment.

Figure 18:
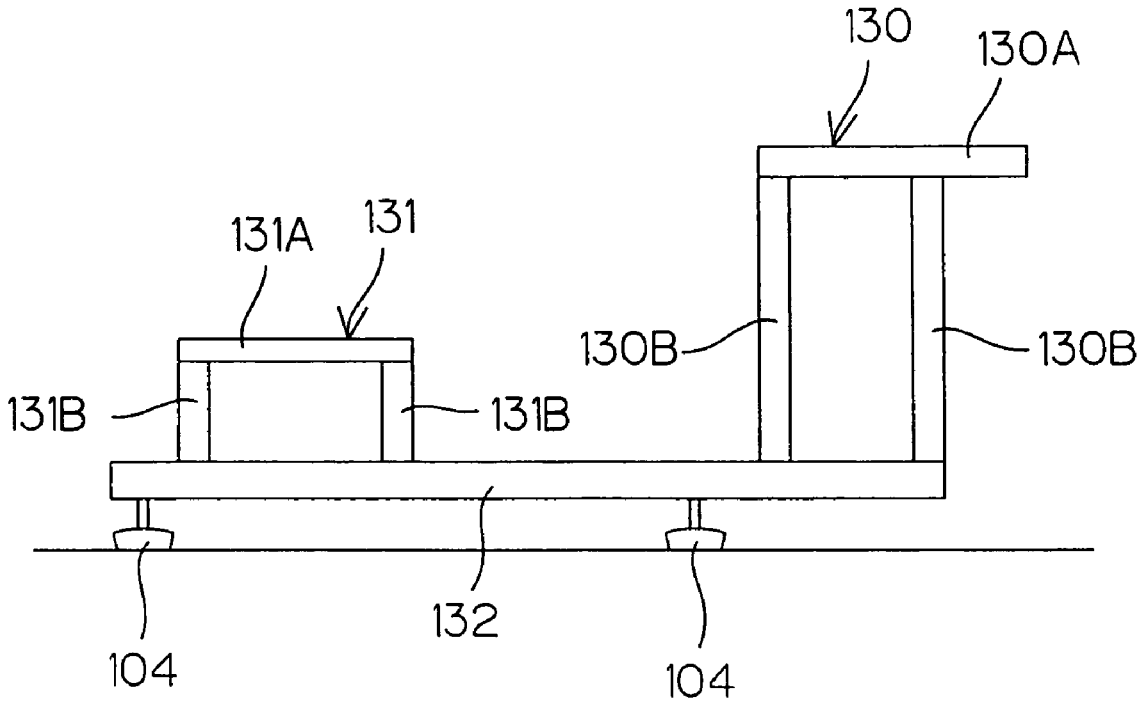
FIG. 18 is a side view illustrating a basin retaining base and a seat retaining base connected by a frame.

FIG. 18 is a side view illustrating the basin retaining base 130 and the seat retaining base 131 connected by the frame 132.

Referring to FIGS. 17 and 18, the automatic shampoo machine 1 is supported by four legs 104 attached to the frame 132 (only two legs are seen in FIGS. 17 and 18). The basin retaining base 130 includes a basin retaining plate 130A for retaining the basin 13, and a support portion 130B for supporting the basin retaining plate 130A at a predetermined height. The seat retaining base 131 includes a seat retaining plate 131A for retaining the seat 2 and a support portion 131B for supporting the seat retaining plate 131A at a predetermined height.

The support portions 130B, 131B are detachably connected to the frame 132, for example, by fixtures not shown. The automatic shampoo machine 1 may be shipped in such a state that the basin retaining base 130 and the seat retaining base 131 are fixed to the frame 132 with the basin 13, the seat 2 and like components mounted therein. Alternatively, the automatic shampoo machine 1 may be assembled at a use site (e.g., in a beauty salon) by fixing the basin retaining base 130 and the seat retaining base 131 to the frame 132.

In the assembled automatic shampoo machine 1, the basin 13 is mounted on the basin retaining plate 130A, and the water supply mechanism is accommodated in a space surrounded by the basin retaining plate 130A and the support portion 130B. Further, the seat adjusting mechanism 121 is mounted on the seat retaining plate 131A, and the seat 2 is retained via the seat adjusting mechanism 121. The electrical component box 17 is accommodated in a space surrounded by the seat retaining plate 131A and the support portion 131B.

The automatic shampoo machine 1 mounted with the respective components is covered with an exterior panel 108 from its lateral and rear sides. Top faces of right and left portions of the exterior panel 108 serve as arm-rests 109. By thus covering the lateral and rear sides of the automatic shampoo machine 1 with the external panel 108, the unitization of the basin 13 and the seat 2 is improved.

In this embodiment, the exterior panel 108 has a rear face 108C inclined downward toward the seat 2, so that a free space S is provided on the rear lower side of the automatic shampoo machine 1. Thus, the operator can easily perform the manual shampooing operation.

In this embodiment, the explanation has been given to the basin retaining base 130 and the seat retaining base 131 which are detachable from the frame 132. However, only one of the basin retaining base 130 and the seat retaining base 131 may be detachable from the frame 132 and the other may be fixed to the frame 132.

Figure 19:
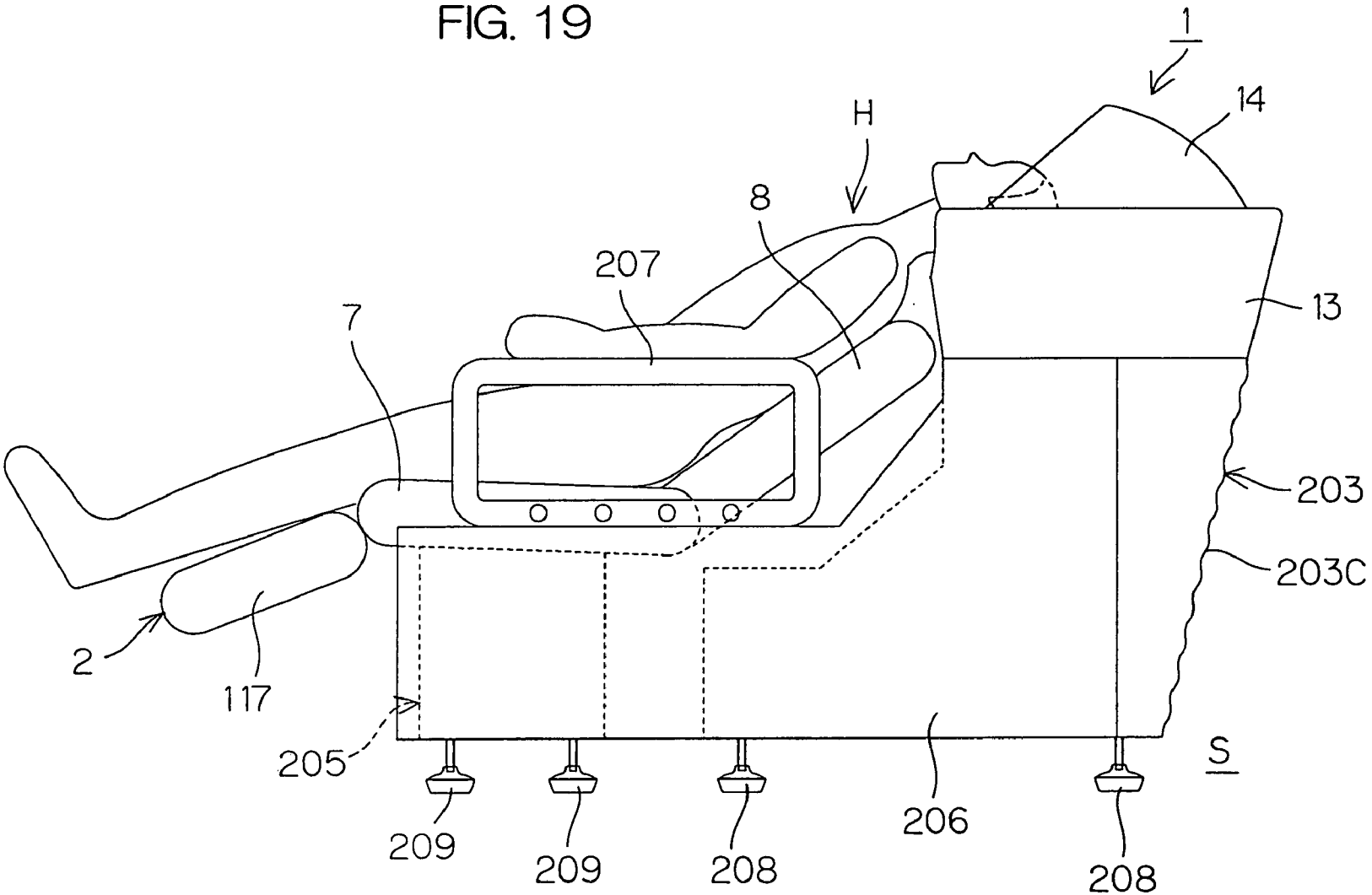
FIG. 19 is a side view illustrating the construction of an automatic shampoo machine according to further another embodiment of the present invention.

FIG. 19 is a side view illustrating the construction of an automatic shampoo machine 1 according to further another embodiment of the present invention.

A feature of this embodiment is that the positioning of a base 13 and a seat 2 is achieved by connecting a basin retaining part 203 with a seat retaining part 205 by an exterior panel 206.

Though not shown in FIG. 19, the basin retaining part 203 retains a water supply mechanism, a warm water reservoir tank, an electrical component box, a drain pan and the like in addition to the basin 13. Further, the seat retaining part 205 retains a seat adjusting mechanism in addition to the seat 2. The basin retaining part 203 and the seat retaining part 205 are each supported by four legs 208, 209 (only two legs for each part are seen in FIG. 19).

In this embodiment, generally rectangular loop-shaped arm-rests 207 are each fixed along one edge thereof to the seat 2, but the construction of the arm-rests is not limited thereto. For example, top face portions of the exterior panel 206 may serve as the arm-rests.

When the basin retaining part 203 and the seat retaining part 205 are to be combined together, the basin retaining part 203 and the seat retaining part 205 are first relatively positioned in a predetermined close relationship, and then their right and left side faces are connected by the exterior panel 206. Thus, the basin retaining part 203 and the seat retaining part 205 are positioned relative to each other. In this embodiment, the exterior panel 206 is attached to the basin retaining part 203 and the seat retaining part 205 to cover a gap anteroposteriorly defined between the basin retaining part and the seat retaining part, so that the unitization of the basin retaining part 203 and the seat retaining part 205 is improved.

In this embodiment, the basin retaining part 203 has a rear face 203C inclined downward toward the seat 2, so that a free space S is provided on the rear lower side of the automatic shampoo machine 1. Thus, the operator can easily perform the manual shampooing operation.

With the arrangement according to this embodiment, for example, an automatic shampoo machine (the basin retaining part 203) may detachably be connected to an all-purpose chair (the seat retaining part 205) by connection means such as the exterior panel 206, or a shampoo chair (the seat retaining part 205) may detachably be connected to an all-purpose automatic shampoo machine (an automatic shampoo machine including no seat, or the basin retaining part 203) by connection means such as the exterior panel 206, in order to improve the unitization of the chair and the automatic shampoo machine.

The present invention is not limited to the embodiments described above, but various modifications may be made within the scope of the invention defined by the following claims.

What is claimed is:

1. An automatic shampoo machine, comprising:

a shampooing section having a basin for receiving a person's head inserted therein and a basin retaining part which retains the basin for receiving the head of the person to be shampooed in the basin and performing a shampooing operation by spouting cleaning water toward the head; and a seating section having a seat for seating the person thereon and a seat retaining part which retains the seat for receiving a body of the person during the shampooing operation;

wherein the basin retaining part and the seat retaining part are slidable with respect to each other so as to be brought into engagement with each other, to constitute connecting means which connect the shampooing section with the seating section, and the shampooing section and the seating section are separable from each other by the connecting means, the automatic shampoo machine further comprising:

an electrical component for controlling an operation of the automatic shampoo machine as a functional component, wherein the electrical component is positioned below the seat.

2. An automatic shampoo machine as set forth in claim 1, further comprising:

an operation panel for operating the automatic shampoo machine; and an arm-rest provided on a lateral side of the seat for receiving an arm of the person sitting on the seat, wherein the operation panel is located on the arm-rest at a position closer to the basin than a portion of the arm-rest on which the person's arm is rested, and inclined at a predetermined angle with respect to a vertical axis.

3. An automatic shampoo machine as set forth in claim 2, further comprising a housing rear face defining a lower rear portion of the basin, wherein the rear face has an oblique surface inclined forwardly downward to provide a free space on a lower rear side of the basin.

4. An automatic shampoo machine as set forth in claim 1, further comprising a warm water reservoir tank for storing warm water for use as the cleaning water, wherein the warm water reservoir tank is positioned between the basin and the seat.

5. An automatic shampoo machine, comprising:

a basin for receiving a person's head inserted therein in a face up condition;

a basin retaining part which retains the basin for receiving the head of the person to be shampooed in the basin;

a shampooing operation performing means for performing a shampooing operation by spouting cleaning water toward the head;

a hood for covering an upper portion of the basin with the face of the person being exposed therefrom;

a seat for seating the person thereon and for receiving a body of the person during the shampooing operation;

a seat retaining part which retains the seat, the basin retaining part and the seat retaining part being detachable with respect to each other, to allow the seat retaining part and the basin retaining part to be brought into engagement with each other and to be separated from each other; and an electrical component for controlling an operation of the automatic shampoo machine as a functional component, the electrical component being positioned below the seat.

* * * * *